US008046962B2

(12) United States Patent
Glick et al.

(10) Patent No.: US 8,046,962 B2
(45) Date of Patent: Nov. 1, 2011

(54) STRUCTURAL TOP CAP ARRANGEMENT FOR WALL PANEL

(75) Inventors: Kristen Glick, Holland, MI (US); Shane Kuipers, Hamilton, MI (US); David Koning, Holland, MI (US); Jason Deweerd, Allegan, MI (US)

(73) Assignee: Haworth, Inc., Holland, MI (US)

( * ) Notice: Subject to any disclaimer, the term of this patent is extended or adjusted under 35 U.S.C. 154(b) by 205 days.

(21) Appl. No.: 11/982,905

(22) Filed: Nov. 6, 2007

(65) Prior Publication Data

US 2008/0104907 A1 May 8, 2008

Related U.S. Application Data

(60) Provisional application No. 60/857,098, filed on Nov. 6, 2006.

(51) Int. Cl.
*E04H 1/00* (2006.01)

(52) U.S. Cl. ..... 52/239; 52/220.7; 52/242

(58) Field of Classification Search ..... 52/239, 52/79.1, 220.7, 238.1, 241, 242, 243
See application file for complete search history.

(56) References Cited

U.S. PATENT DOCUMENTS

| | | | | |
|---|---|---|---|---|
| 2,970,677 | A | 2/1961 | Springs et al. | |
| 3,807,102 | A | 4/1974 | Albinson | |
| 4,147,198 | A * | 4/1979 | Ytter | 160/135 |
| 4,213,493 | A | 7/1980 | Haworth | |
| 4,631,881 | A | 12/1986 | Charman | |
| 4,698,946 | A * | 10/1987 | Wendt | 52/275 |
| 4,891,922 | A | 1/1990 | Hozer et al. | |
| 4,907,783 | A * | 3/1990 | Fisk et al. | 256/32 |
| 5,488,808 | A | 2/1996 | Cahill et al. | |
| 5,524,402 | A * | 6/1996 | Sykes | 52/243.1 |
| 5,642,593 | A * | 7/1997 | Shieh | 52/239 |
| 5,682,719 | A * | 11/1997 | Huang | 52/775 |
| 5,797,440 | A | 8/1998 | Tsai | |
| 5,839,240 | A | 11/1998 | Elsholz et al. | |
| 6,088,981 | A | 7/2000 | Edwards | |
| 6,115,977 | A | 9/2000 | Hornberger et al. | |
| 6,131,347 | A | 10/2000 | Hornberger et al. | |
| 6,141,926 | A * | 11/2000 | Rossiter et al. | 52/239 |
| 6,389,773 | B1 * | 5/2002 | Reuter et al. | 52/582.2 |
| 6,397,533 | B1 | 6/2002 | Hornberger et al. | |
| 6,415,567 | B1 * | 7/2002 | Mead et al. | 52/239 |
| 6,435,253 | B1 | 8/2002 | Steeves et al. | |
| 6,557,310 | B2 | 5/2003 | Marshall et al. | |

(Continued)

FOREIGN PATENT DOCUMENTS

EP 0 293 240 A2 11/1988

(Continued)

*Primary Examiner* — Basil Katcheves
*Assistant Examiner* — Branon Painter
(74) *Attorney, Agent, or Firm* — Warner Norcross & Judd LLP

(57) ABSTRACT

An upright space-dividing wall panel is provided having an internal frame and a top cap attached to a top rail of the frame. The top cap includes a lengthwise channel in which threaded fasteners are slidably received for engaging the top cap to the frame rail. The top cap further includes side channels which cooperate with coupling brackets for securing a second panel to the wall panel. Further, a locator clip arrangement is provided between the top cap and a side trim cover on the end of the wall panel for precisely locating the trim cover relative to the top cap.

24 Claims, 19 Drawing Sheets

U.S. PATENT DOCUMENTS

| | | | | |
|---|---|---|---|---|
| 6,748,710 | B2 | 6/2004 | Gresham et al. | |
| 6,807,776 | B2 | 10/2004 | Girdwood et al. | |
| 6,964,138 | B2 * | 11/2005 | Carroll et al. | 52/239 |
| 2001/0029713 | A1 * | 10/2001 | Beck et al. | 52/239 |
| 2002/0117270 | A1 | 8/2002 | Steeves et al. | |

FOREIGN PATENT DOCUMENTS

| | | | |
|---|---|---|---|
| FR | 2 683 842 | A1 | 5/1993 |
| WO | WO 2005/078208 | A1 | 8/2005 |

* cited by examiner

STRUCTURAL TOP CAP ARRANGEMENT FOR WALL PANEL

CROSS REFERENCE TO RELATED APPLICATION

This application claims the benefit of U.S. Provisional Application No. 60/857,098, filed Nov. 6, 2006, which is incorporated herein by reference in its entirety.

FIELD OF THE INVENTION

This invention relates to an improved top cap arrangement for use on upright wall panels associated with a wall system.

BACKGROUND OF THE INVENTION

Interior wall systems formed from a plurality of upright interior panels which are typically serially joined in aligned and/or transverse relationship are conventionally utilized in offices and the like to divide large open areas into smaller work spaces. The upright wall panels are typically manufactured in the factory with final assembly occurring at the job site, which final assembly typically involves attachment of removable cover pads to opposite sides of the upright panel frame, and attachment of various trim pieces along the edges, such as a top cap along the top edge of the panel. In many instances the top cap is solely for trim purposes and imparts little, if any, structural integrity to the wall panel. In recent years, however, some panel assemblies have been developed which employ a structural top cap, although many of these known arrangements have involved either undesired size or structural complexity, or have provided limited functionality.

Interior space-dividing wall systems of the type described above generally permit panels to be joined in right-angled relationship to one another, such as L-shaped or T-shaped configurations, although the perpendicularly joined panels are typically joined at the panel edges. In recent years other connection techniques have been developed whereby one upright panel can be perpendicularly joined to a second upright panel, with the joinder being disposed at a location which is displaced from the upright edges of the second panel, specifically at a location disposed between the upright edges. This is commonly referred to as an "off-modular" mounting, that is the mounting is not limited to locations corresponding to the end edges of the individual wall panels. Many of the off-modular connection techniques utilized for joining two perpendicularly-related panels, however, have involved either complex arrangements or, more significantly, have presented limitations with respect to the forces or loads transferred between the connecting structure and/or have resulted in a rather complex assembly process.

Accordingly, it is an object of this invention to provide an improved top cap arrangement for an upright wall panel, which improved top cap arrangement is believed to provide improved characteristics with respect to both the structure of the upright panel and the ability thereof to structurally permit off-modular joining between perpendicular panels, thereby improving upon the overall characteristics in a manner which is believed to overcome some of the disadvantages associated with prior systems.

More specifically, this invention relates to an improved upright space-dividing wall panel having an internal frame which permits pads or covers to attach to opposite sides thereof, and a horizontally elongate top cap which rigidly attaches to a top rail of the frame and extends throughout the lengthwise extent of the wall panel. The top cap is preferably constructed as a monolithic one-piece metal structure which secures to the frame top rail by a plurality of threaded fasteners disposed in spaced relationship along the lengthwise extent of the top cap. The fasteners engage internally of the top cap so as to be not externally visible.

The top cap in a preferred construction is lengthwise extruded of aluminum, and defines a downwardly-opening bottom channel extending lengthwise generally along the centerline thereof, which channel has a generally T-shaped cross-section whereby enlarged heads of threaded fasteners are slidably inserted within the channel from one end of the top cap and are non-visibly captivated in the channel so as to permit fixed securement of the top cap to the frame top rail.

The invention also includes a wall panel having an improved structural top cap, as aforesaid, wherein the top cap has secondary channels which open downwardly thereof and extend lengthwise of the top cap in parallel relationship to and generally on opposite sides of the center channel. The side channels cooperates with a top coupling brackets which can be slidably inserted into and positioned along the secondary channel at any location therealong to permit off-modular connection to a second panel which is disposed adjacent and extends perpendicular to the adjacent side of the panel on which the coupling bracket is mounted.

The wall system of this invention, as aforesaid, includes not only a top coupling bracket which structurally mounts directly on the top cap of a main panel and is slidable therealong for disposition at any desired location, but also includes a bottom coupling bracket which mounts on a lower pan or frame member of the main panel at any location therealong. The top and bottom brackets cooperate with upper and lower corners of a secondary panel so as to rigidly couple the secondary panel to the main panel in a perpendicular off-modular relationship, with significant loads generated by the secondary panel being transmitted through the top bracket to the structural top cap of the main panel.

Other objects and purposes of the invention will be apparent to persons familiar with constructions of this general type upon reading the following specification and inspecting the accompanying drawings.

Figure 1:
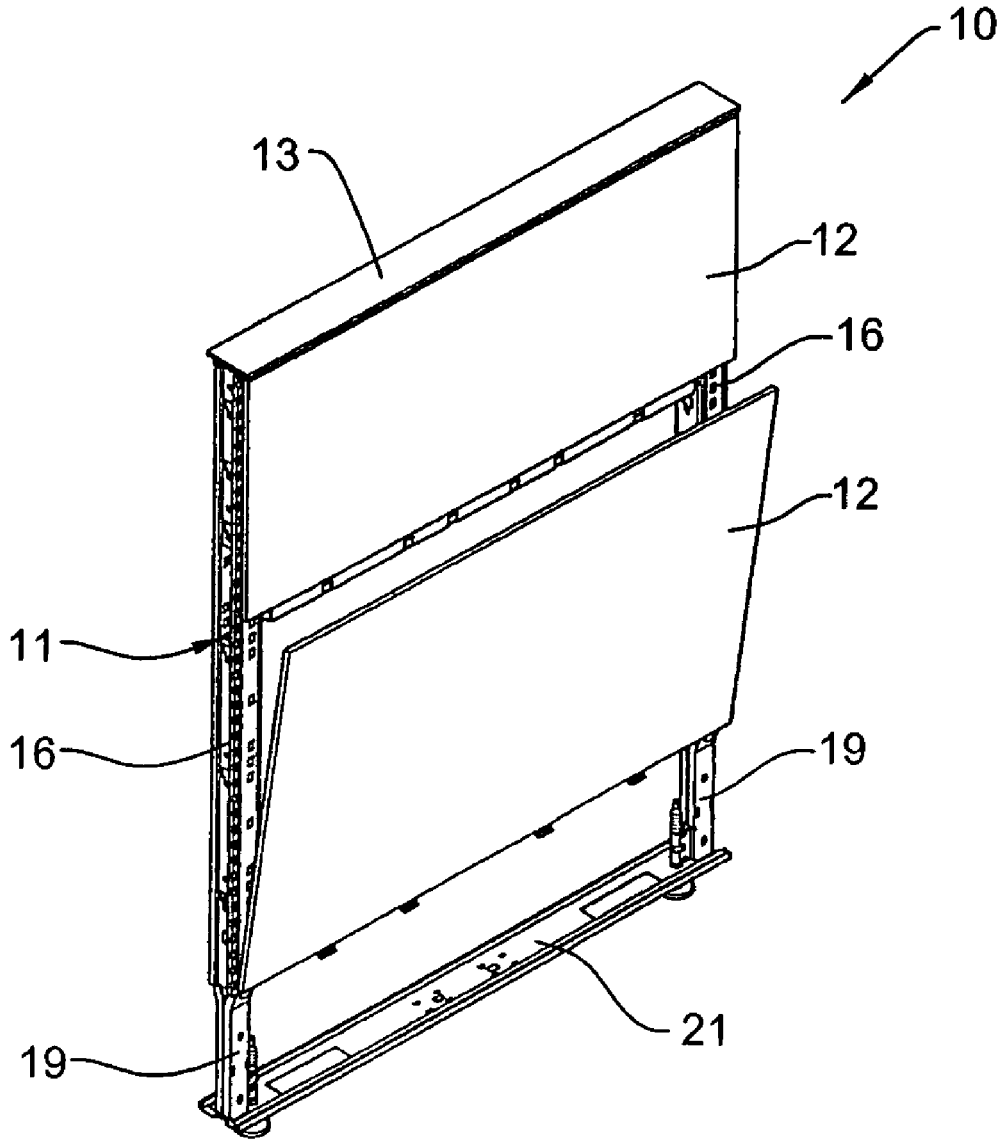
FIG. 1 is a perspective view of an upright wall panel which incorporates thereon the improved structural cap arrangement of this invention.

Certain terminology will be used in the following description for convenience and reference only, and will not be limiting. For example, the words "upwardly", "downwardly", "rightwardly" and "leftwardly" will refer to directions in the drawings to which reference is made. The words "upper" and "lower" will also refer to portions of the panel when in its normal vertically-oriented position of use. The words "inward" and "outward" will refer to directions toward and away from, respectively, the geometric center of the panel and designated parts and assemblies associated therewith. Said terminology will include the words specifically mentioned, derivatives thereof, and words of similar import.

DETAILED DESCRIPTION

Referring to FIG. 1, there is illustrated an upright space-dividing wall panel 10 of the type used for creating an upright wall system, which system involves joinder of several such panels in adjacent aligned and/or transverse relationship for at least partially enclosing workspaces and the like. The use of upright wall panels, and the joinder of a plurality of such panels in aligned and/or transverse relationship to define workspaces and the like, is a well known and extensively utilized practice, whereby further description and discussion thereof is believed unnecessary.

Figure 2:
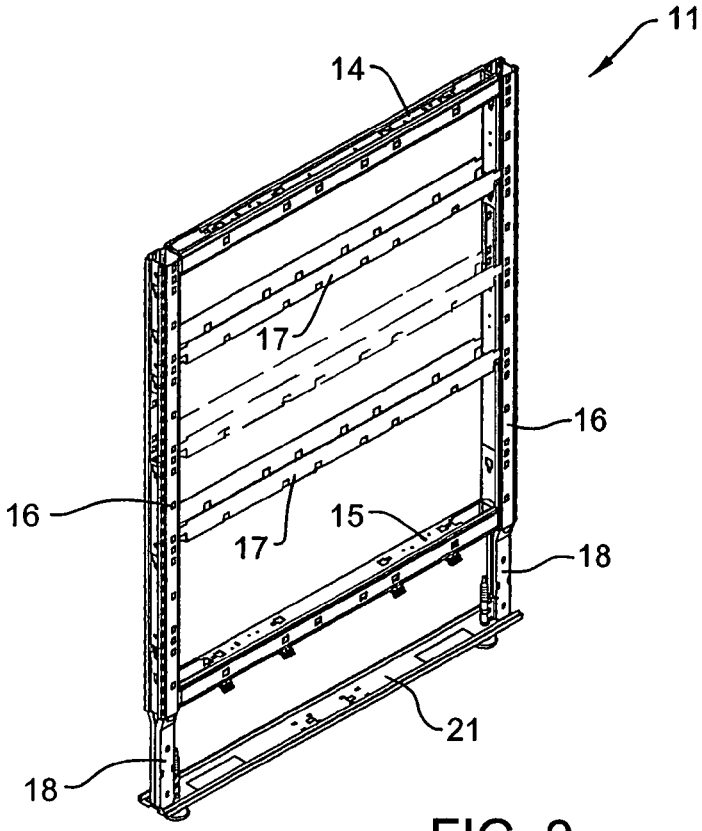
FIG. 2 is a perspective view of solely the rigid interior frame as associated with the upright wall panel of FIG. 1, the side cover pads being removed for clarity of illustration.

The wall panel 10, as illustrated by FIG. 2, includes an interior upright frame 11 which, as is also known, is adapted to removably mount one or more cover pads or tiles 12 on opposite side faces of the frame. In the wall panel 10 of this invention, the panel is provided with an improved structural top cap arrangement, the latter specifically including an elongate top cap 13, which rigidly couples to and extends lengthwise along the upper edge of the interior frame, as explained in greater detail hereinafter.

The interior frame 11 may assume other known constructions but, in the illustrated embodiment, is of a generally open but rectangular rigid construction defined by horizontally elongated and vertically spaced top and bottom frame rails 14 and 15, respectively, which frame rails in turn are rigidly joined adjacent opposite ends thereof by upright edge or side rails 16 which extend vertically in generally perpendicular relationship to the horizontal rails 14-15. The frame rails 14, 15 and 16, in the illustrated and preferred construction, are rigidly joined, such as by welding, and each is preferably formed from an elongate hollow metal tube having a cross-section which is generally rectangular and more specifically generally square. The frame rails, including specifically the uprights 16, are provided with openings through the side faces thereof which, in a conventional manner, accommodate clips or hooks provided on the cover pads 12 for permitting the cover pads to be attached to the frame substantially in engagement with the side faces thereof. The frame 11 as illustrated by FIG. 2 may also be provided with intermediate horizontally extending cross-rails or beams 17 which can be either permanently or removably engaged with the uprights 16, whereby the number and location of such crossbeams can be selected in accordance with the mode of usage of the upright wall panel, the size and number of cover pads provided on the side faces thereof, and the types and locations of cooperating accessory structures.

Figure 3:
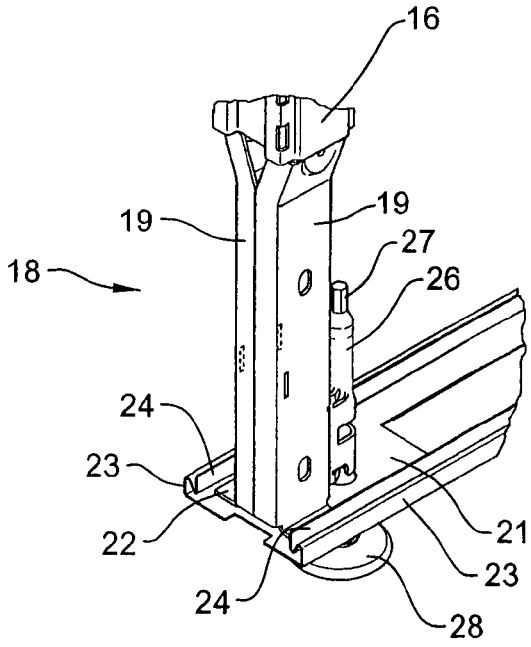
FIG. 3 is an enlarged fragmentary perspective view showing a lower corner portion of the frame illustrated in FIG. 2.

In the frame 11 as illustrated by FIGS. 2 and 3, each of the uprights 16 has a lower end part 18 which is configured to define an open interior raceway extending horizontally along the panel adjacent the lower edge thereof for accommodating telecommunication and/or electric cabling therein. This lower end part 18, to provide clearance for cabling which extends horizontally between adjacent panels, is defined generally by platelike side members 19 which protrude upwardly and are joined generally back-to-back, thereby providing clearance for cables adjacent opposite side faces thereof. This lower leg part 18 rigidly joins to a horizontally elongate member, specifically a bottom pan 21 which is vertically spaced downwardly from but extends generally parallel with the horizontal rail 15. This member 21 is fixedly secured to lower ends of the leg parts 18 and, for this purpose, the lower ends of the side members 19 define thereon a pair of generally horizontally oriented side flanges 22 (FIG. 3) which protrude sidewardly in opposite directions and which bear on the bottom pan 21.

The pan 21 has upwardly protruding side flanges 23 which extend upwardly adjacent opposite sides of the bottom wall and protrude lengthwise therealong, whereby the bottom pan 21 has a generally cup-shaped upwardly-opening configuration, and has a width which generally corresponds to the width of the frame uprights 16 and associated cover tiles 12. The bottom pan side flanges 23, at the upper lengthwise-extending extremities thereof, are provided with upper edge parts 24 which are initially bent inwardly and then upwardly so as to define a shoulder or step on which a lower horizontally extending edge of a removable side cover or tile 12 can be positioned.

The lower end part 18 of each frame upright 16 also has, as illustrated in FIG. 3, a leg support bracket 26 fixed thereto, such as to an inner surface of the lower part 18. This leg support bracket accommodates therein a vertically elongated threaded shaft 27 which can be rotatably threadably moved relative to the bracket so as to adjust the elevation of the threaded shaft, which threaded shaft at its lower end mounts a support foot or glide 28 which provides a cooperative supportive engagement with a floor. When the selected wall panels have been joined serially in a desired orientation, such as in aligned or transverse orientation, then a side cover pad can be attached to the frames in a desired and generally conventional manner, such being diagrammatically depicted in FIG. 1 which illustrates one of the cover pads in a partially detached condition.

Figure 5:
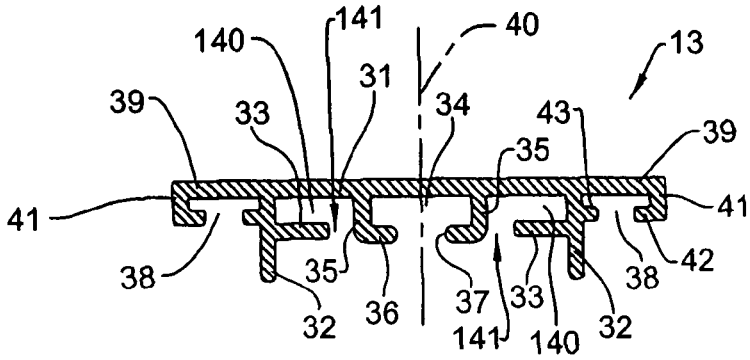
FIG. 5 is an enlarged cross-sectional view of solely the top cap.
Figure 6:
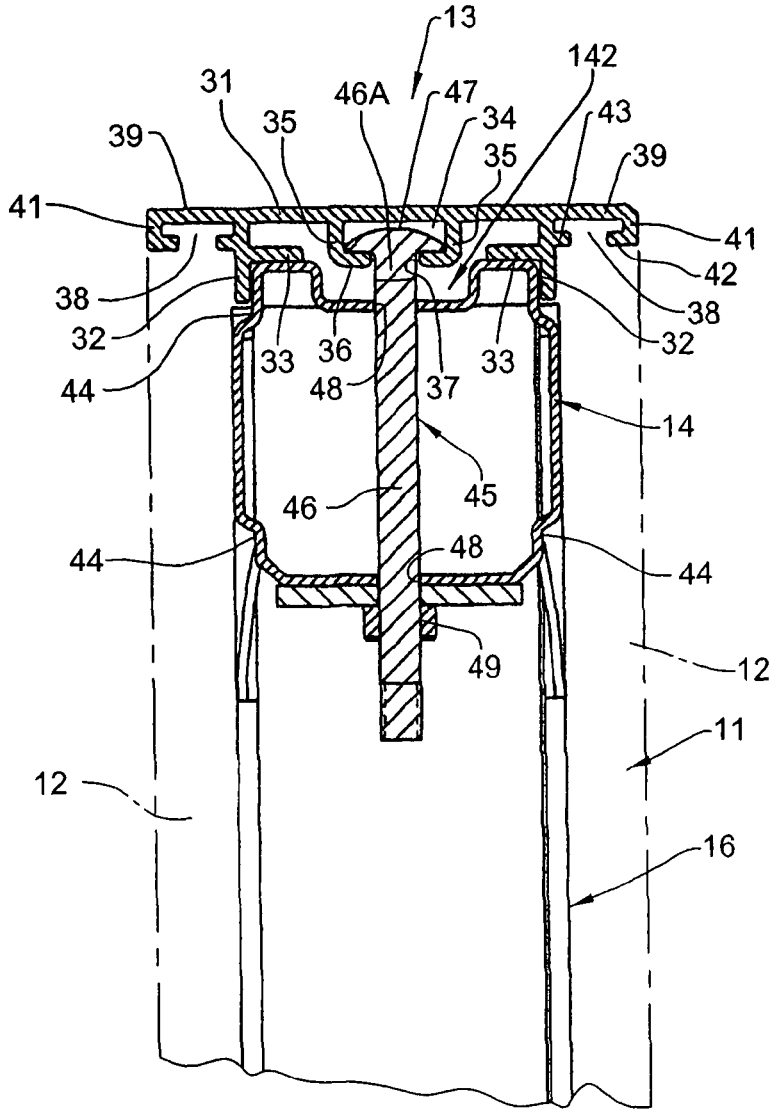
FIG. 6 is an enlarged fragmentary cross-sectional view through the top frame rail and the attached structural top cap.

Referencing now FIGS. 5 and 6, there is illustrated the structural top cap 13 which, in accordance with the present invention, is preferably constructed as an elongate, rigid, one-piece monolithic structural member, preferably a metal member which in a preferred construction is a one-piece elongate extruded aluminum member so as to provide structural strength and rigidity when fixedly attached to the upper edge of a wall panel, and permitting securement between perpendicularly joined panels, as explained hereinafter.

The structural top cap 13 includes a main generally horizontally oriented top wall 31 which has a pair of generally parallel and sidewardly spaced side walls 32 joined thereto and cantilevered downwardly therefrom. These side walls 32, which extend throughout the entire length of the top cap 13, are sidewardly spaced by a distance which generally corresponds to the width of the top frame rail 14. This latter frame rail 14, as well as the other frame rail members, preferably has the side walls thereof provided with slight depressions 44 formed therein adjacent the opposite lengthwise extending edges of the respective side wall, and these shallow depressions 44 as defined on opposite sides of the top frame rail 14 accommodate therein the downwardly cantilevered side walls 32 substantially as illustrated in FIG. 6, whereby exterior sides of the side walls 32 are hence substantially flush with exterior faces of the top rail 14. The downwardly cantilevered side walls 32, at a location spaced downwardly from the top wall 31 but spaced upwardly from the lower edges thereof, are provided with horizontal stop flanges 33 which are cantilevered inwardly in aligned relationship toward one another. These latter stop flanges 33 bear against the exposed upper surface of the top frame rail 14 so that, in conjunction with the protrusion of the side walls 72 into the shallow recesses 44, ensure that the top cap 13 properly positionally seats on the top rail 14.

The top cap 13 also includes an elongate downwardly-opening channel 34 which is defined under the top wall 31 and extends lengthwise generally along the centerline thereof. This channel 34 is defined by a pair of sidewardly spaced side flanges 35 which extend lengthwise of the top cap in generally parallel relationship, and which are cantilevered downwardly from the top wall 31 on opposite sides of the longitudinally or lengthwise extending centerline. The side flanges 35 are spaced inwardly from the side walls 32, and are provided at their lower edges with inwardly turned retaining flanges 36 which are disposed in opposed aligned relationship to one another. These lower retaining flanges 36 define a narrow slot 37 therebetween which extends lengthwise of the cap and defines the mouth or access opening into the channel 34, which channel has a greater width than the mouth 37. This channel 34 and its access opening or mouth 37 hence is generally T-shaped in cross-section.

As further illustrated in FIGS. 5-6, the cap 13 includes overhanging parts 39 which protrude outwardly beyond the side walls 32 and extend throughout the lengthwise extent of the cap. These overhanging parts 39 are defined by sideward extensions of the top wall 31, which sideward extension terminates at an edge wall or flange 41 which is cantilevered downwardly from the top wall through a small extent, and which extends throughout the full lengthwise extent of the top cap. This edge wall 41 at its lower free edge terminates in a small in-turned edge flange 42 which is spaced downwardly from the top wall 31, and which is disposed horizontally opposite but spaced from a further small horizontally protruding flange 43 which is joined to and protrudes outwardly from the respective side wall 32. The opposed flanges 42-43, both of which extend throughout the full lengthwise extent of the cap, define therebetween a narrow mouth portion which opens upwardly and communicates with a larger space defined by the top wall 31 and the flanges 42-43 spaced downwardly therefrom, thereby defining a T-shaped slot 38 which slidably accommodates therein an upper bracket member associated with a top bracket arrangement, as explained hereinafter.

As illustrated by FIGS. 5-6, the structural top cap 13 is generally symmetrical about a vertical or upright plane 40 which contains the lengthwise-extending centerline of the top cap.

To fixedly secure the structural top cap 13 to the upper edge of the panel frame 11, a pair of fasteners 45 are provided for cooperation between the cap 13 and the top frame rail 14. The fastener 45 is preferably a conventional carriage bolt having an elongate shaft 46 provided with an enlarged head 47 at the upper end. The shaft 46 has a square portion 46A directly below the head 47 so as to permit the bolt 45 to be slidably moved lengthwise along the channel 34, while at the same time restricting rotation of the bolt. The lower end of the shaft 46 is threaded and adapted to have a conventional nut 49 threadedly engaged thereon. The shaft 46 of the carriage bolt is adapted to extend through aligned openings 48 formed in the top and bottom walls of the top rail 14 so that the nut 49 can be threaded onto the lower protruding end of the shaft 46 to securely draw the top cap 13 down into seated engagement with the top rail 14 as illustrated in FIG. 6.

The top cap 13 is preferably secured to the top rail 14 by two or more carriage bolts carried thereon in spaced relationship therealong, whereby the carriage bolts align with openings 48 which extend vertically through the top rail so as to permit the top cap to be moved downwardly and seated on the top rail while enabling the bolts to project therethrough, following which the nuts are secured so as to draw the cap into snug engagement with the top rail.

As an alternative mounting technique, the bolts 45 can be initially inserted through the openings 48 in the top rail 14, and then the top cap 13 is disposed in laterally offset but aligned relationship with the top of the panel frame so that the bolt head 47 of the first bolt is located directly adjacent the free end of the top cap. The bolt can be manually raised a small extent so as to enable the top cap 13 to be slidably displaced so that the head 47 of the bolt enters the channel 34. The top cap 13 is progressively slidably displaced lengthwise along the top rail 14 until all of the bolt heads have been slidably inserted into the channel 34, and the top cap is properly aligned so that the ends of the top cap correspond to the edges of the frame. The nuts 49 can then be engaged and tightened to draw the top cap 13 against the top rail 14.

In either case, the bolt head 47 is not restricted longitudinally to any specific location along the length of the top cap 13 and the channel 34 thereof. While the bolts 45 do correspond to the respective bolt openings 48, the specific position of the top cap 13 may be set longitudinally before the nuts 49 are tightened to fix the top cap 13 in position. As a result thereof, the position of the top cap 13 relative to the ends of the wall panel 11 may be precisely aligned before the nuts 49 are tightened.

The aforementioned top cap and top rail arrangement, and particularly the structural characteristics provided by the top cap 13 and its manner of seating on the top rail 14, provide significant strength and rigidity to the overall frame, and to the assembled upright panel. After the top cap 13 has been secured using either of the techniques described above, then the side covers 12 can be attached to opposite sides of the frame, which side covers have outer surfaces disposed so as to be substantially flush with exterior sides defined by the edge flanges 41 of the top cap.

While the retaining flanges 36 which define the narrow slot 37 can be notched at selected locations so as to permit the bolt head 47 to be inserted upwardly and then slidably displaced sidewardly into the channel 34, such notching complicate the overall construction of the top cap and increases the overall cost. Accordingly, by forming the top cap as an elongate extruded metal element, without thereafter carrying out further notching or machining operations for permitting vertical insertion of the bolt heads, a highly desirable structural top cap can be provided at a more economical cost.

Figure 7:
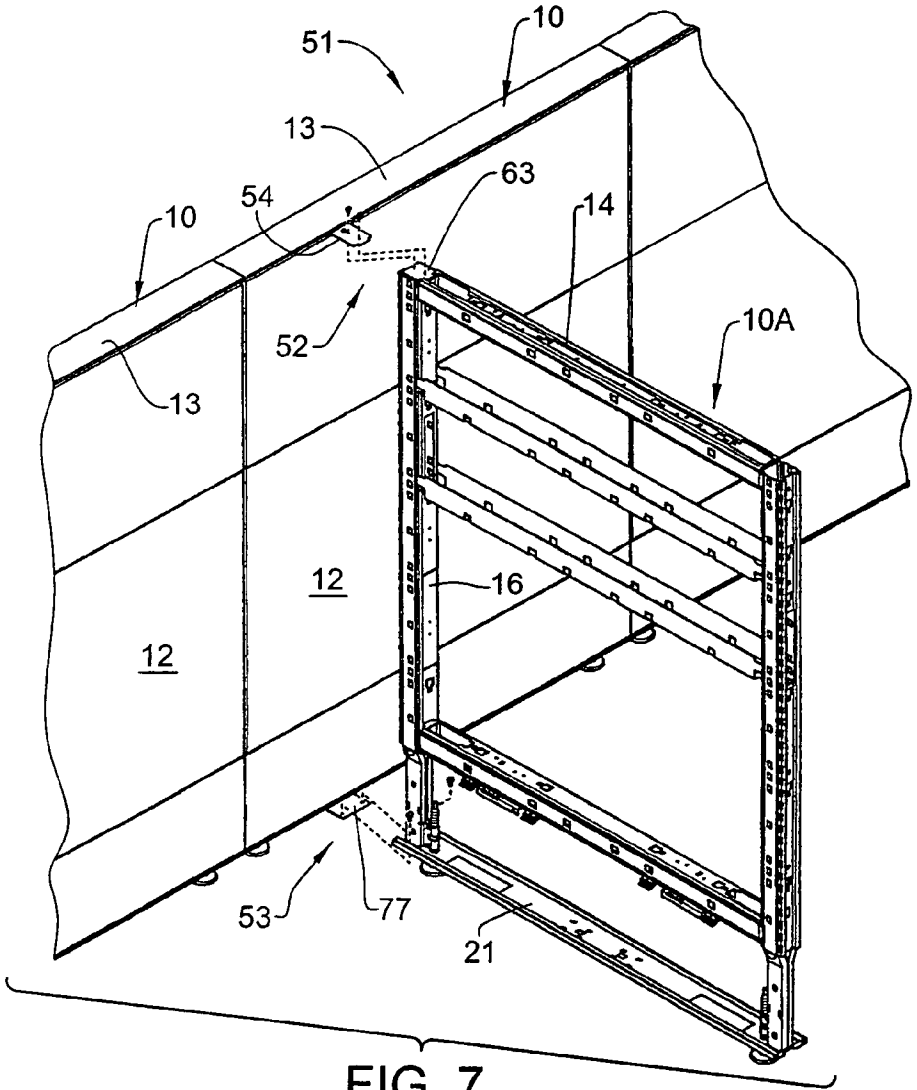
FIG. 7 is a fragmentary perspective view illustrating a wall system wherein a first upright wall panel connects in transverse and off-modular relationship to a second upright wall panel, the first panel being illustrated with its side covers removed and in a separated position relative to the second panel.

Referring now to FIG. 7, there is illustrated an upright wall system 51 constructed from a plurality of panels which are joined to define what is commonly referred to as a T-configuration when viewed from above, including a first or primary upright panel 10 having a second or secondary upright panel 10A joined thereto in generally perpendicular relationship. The joinder in the arrangement of FIG. 7 is of the type commonly referred to as "off-module" in that the secondary panel 10A joins to the side of the primary panel 10 at a location spaced from the upright end edges thereof. The wall system 51 in FIG. 7 illustrates the primary panel 10 having side cover pads attached to at least the side thereof which faces the secondary panel 10A, whereas the secondary panel 10A is shown with the cover pads removed to facilitate attachment of the secondary panel to the primary panel. It should be noted that the reference to "primary" and "secondary" is solely for convenience in distinguishing between the two panels, since it will be appreciated that the two panels can be and frequently are identical.

To effect fixed perpendicular securement of the secondary panel 10A to the side face of the primary panel 10, an upper connecting bracket arrangement 52 cooperates between the top cap 13 of the primary panel 10 and the upper corner of the secondary panel 10A. In addition, a lower or bottom connecting bracket arrangement 53 couples between the bottom frame element of the primary panel 10, and the bottom frame element of the secondary panel 10A.

Figure 8:
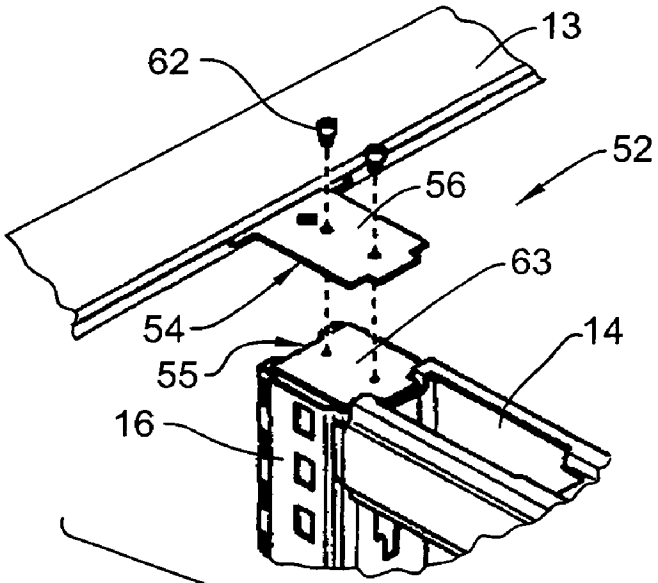
FIG. 8 is an exploded fragmentary perspective view which illustrates the upper bracket structure, in separated condition, for joining upper edges of the first and second panels in transverse relationship.
Figure 10:
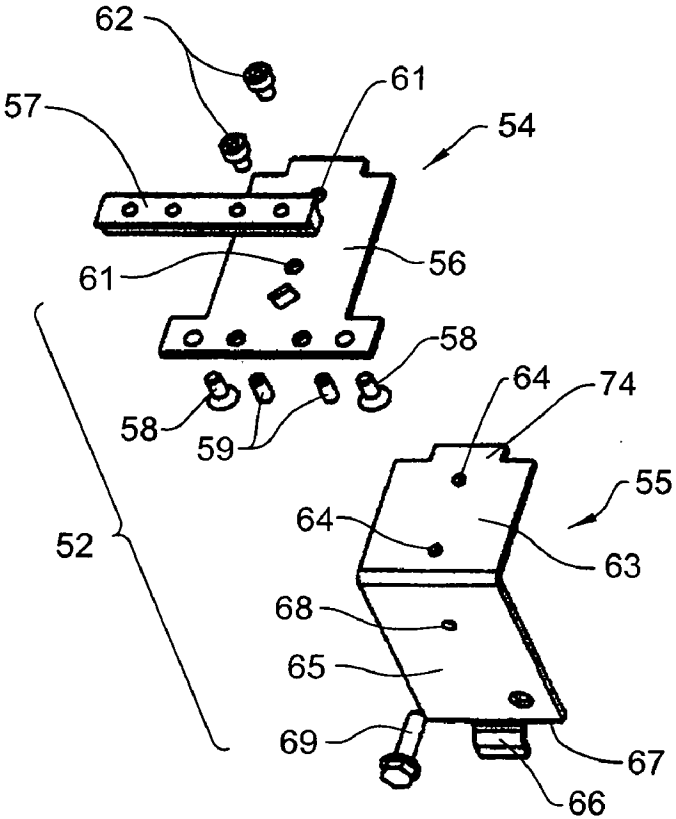
FIG. 10 is an enlarged, exploded perspective view illustrating the upper bracket structure which cooperates for joining first and second panels in transverse relationship.

The top bracket arrangement 52, as illustrated by FIGS. 8 and 10, is defined by two primary elements, namely a first bracket member 54 which couples to the top cap 13 of the primary panel 10, and a second bracket member 55 which couples to the adjacent upper corner of the frame associated with the secondary panel 10A.

Figure 14:
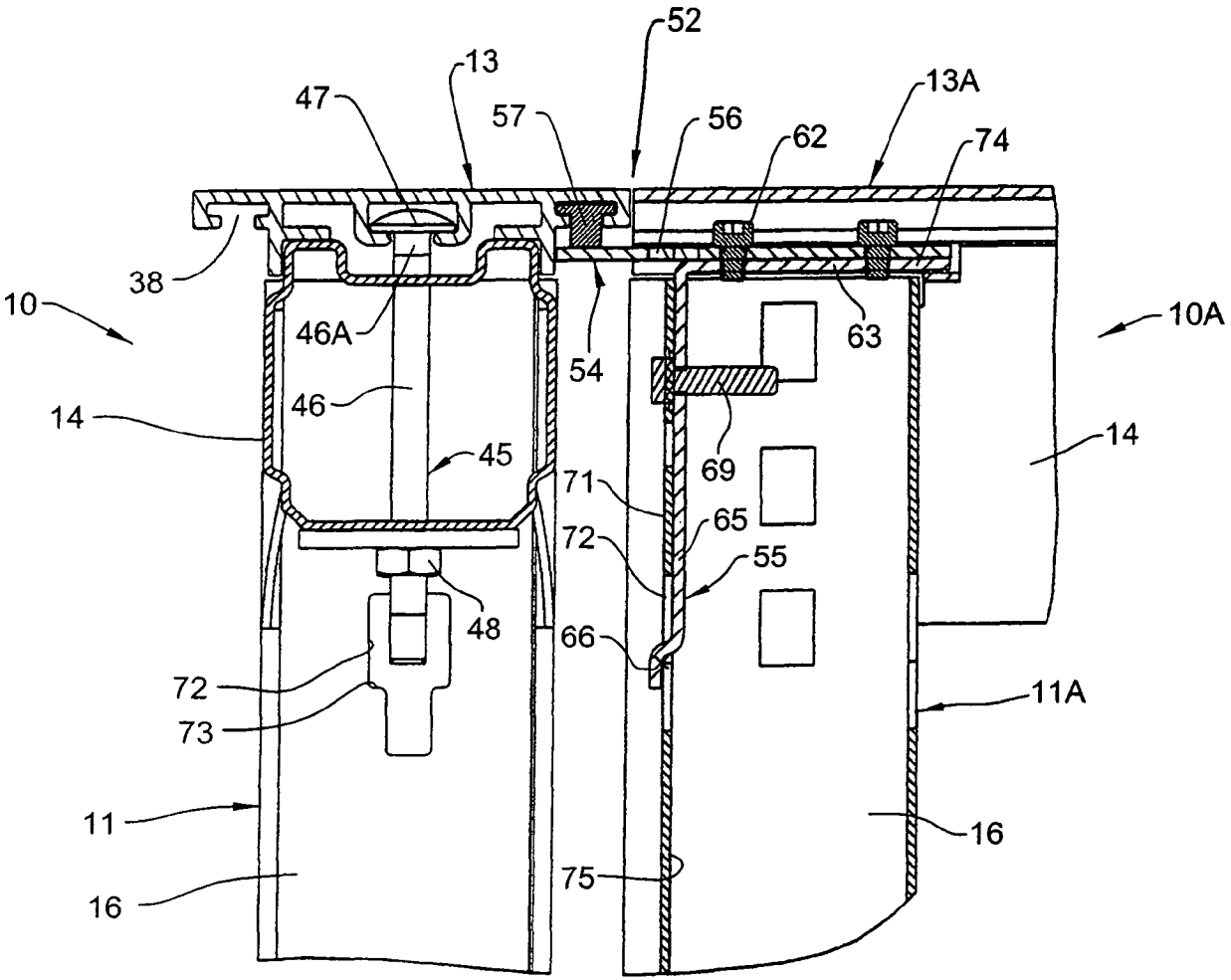
FIG. 14 is an enlarged, fragmentary sectional view which illustrates the upper bracket structure and its joinder to first and second panels for securing upper edges of the panels in transverse relationship to one another.

As shown by FIG. 10, the top bracket member 54 is defined by a main horizontal support plate 56 which, adjacent one edge, has an elongate guide rail 57 fixed to and protruding upwardly from the upper surface thereof. This guide rail 57, in transverse cross-section, has a generally T-shaped configuration as illustrated in FIG. 14. This guide rail 57 in the illustrated construction is fixed to the bracket plate 56 by a pair of threaded fasteners or screws 58. The guide rail 57 also has a pair of threaded set screws 59 carried thereon, the latter being used for fixedly securing the bracket member 54 to the cap 13 when the T-shaped rail 57 is engaged within the selected T-shaped channel 38 of the cap 13. The one edge of the plate 56, as well as the guide rail 57 secured thereto, preferably are elongated relative to the width of the plate 56 so as to provide a longer rail for slidable engagement within the top cap channel 38.

The main support plate 56 of the bracket member 54 has a pair of openings 61 extending therethrough, which openings are disposed generally on a centerline which extends transverse to the edge rail 57. The openings 61 accommodate therein threaded fasteners or screws 62 which are provided for connecting the first bracket member 54 to the second bracket member 55.

As to the second bracket member 55, it has a generally L-shaped configuration, preferably being bent from flat metal plate, and includes a top leg or plate 63 and a side leg or plate 65 which is joined to one edge of the top leg 63 and protrudes vertically downwardly therefrom in substantially perpendicular relationship thereto. The top leg 63 has a pair of threaded openings 64 extending vertically therethrough generally along the transverse centerline. The openings 64 are positioned to align with the openings 61 when the plate 56 is positioned over the plate 63 so that the threaded fasteners 62 can be engaged therewith to rigidly couple the plates 56 and 63 together as illustrated in FIG. 14.

The vertical or down leg 65, at the lower edge 67 thereof, has a downwardly cantilevered mounting flange 66 which is generally Z-shaped in longitudinal cross-section and functions as a hook. The vertical leg or plate 65 also has a threaded opening 68 extending therethrough at a location spaced upwardly from the hook 66. This opening 68 cooperates with a threaded fastener or screw 69 which is inserted through an appropriate opening formed in the outer side wall of the frame upright 16 (FIG. 14) of the panel 10A so as to fixedly secure the vertical leg 65 in direct abutting contact with the inner side surface 75 of the edge rail 16.

The top leg or plate 63 also has, on the edge thereof opposite the side leg 65, a protruding edge part or extension 74 which, when the second bracket member 55 is secured to the frame upright 16 as illustrated in FIG. 14, overlaps and effectively seats on the upper edge of the inner side wall of the frame upright 16.

Figure 13:
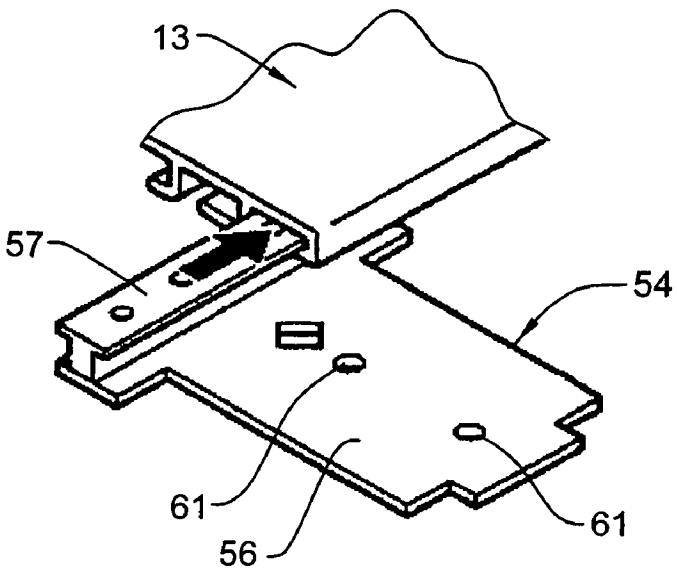
FIG. 13 is an enlarged, fragmentary perspective view showing the end of the top cap and the manner for slidably inserting the upper bracket member thereon.
Figure 12:
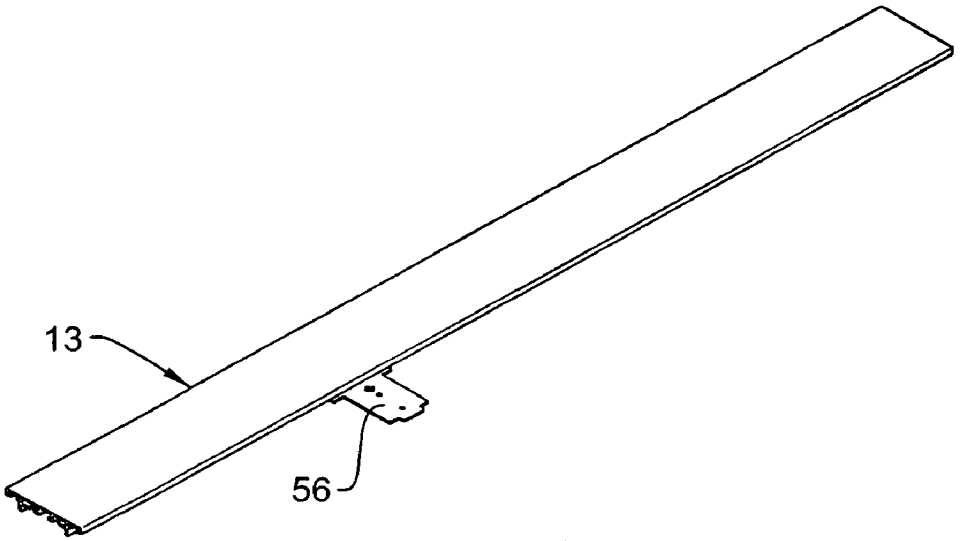
FIG. 12 is a perspective view of solely the structural top cap, shown removed from the interior frame, and having part of the top bracket structure mounted thereon.

To utilize the top bracket arrangement 51 to effect securement of the secondary panel 10A in an off-module perpendicular positional arrangement adjacent one side of the primary panel 10, the first bracket member 54 is initially fixed to the panel 10, and the second bracket member 55 is initially fixed to the secondary panel 10A, prior to these panels being joined. This is accomplished by initially inserting the T-shaped guide rail 57 into the end of the selected guide channel 38 associated with the top cap 13 of the panel 10, as illustrated by FIG. 13. The first bracket member 54 is then slidably moved lengthwise of the guide channel 38 to the desired location, and the bracket member 54 can then be fixed to the top cap 13 by tightening the set screws 59 which are accessible through the mouth of the channel 38.

The second bracket member 55 is also initially fixedly mounted to one of the upright edge rails 16 associated with the secondary panel 10A. To effect this mounting, the second bracket member 55 is oriented so that the vertical plate 65 protrudes downwardly, whereupon this plate 65 is manually moved downwardly into the interior of the edge rail 16. When substantially fully inserted, the lower hook 66 aligns with a slot or opening 72 (FIG. 14) formed through the outer side wall of the edge rail 16. The second bracket member 55 is then moved toward this outer side wall, namely toward the inner surface 75 thereof, causing the hook 66 to pass through the opening 72. With the plate 65 positioned substantially directly adjacent this inner surface 75, the second bracket member 55 is then slidably moved downwardly which causes the hook 66 to engage a lower edge 73 of the opening 72. At substantially the same time, the upper protruding edge part 74 is positioned directly over and disposed substantially in engagement with an upper edge of the inner side wall of the upright edge rail 16, substantially as illustrated by FIG. 14. The screw 69 is then threaded through an opening formed in the side wall, which opening can be pre-formed or formed at the time of installation, whereupon the screw 69 then extends through the threaded opening 68 so as to fixedly draw the vertical plate 65 against the side wall of the upright and hence secure the L-shaped bracket member 55 to the upper end of the edge rail 16.

With the first and second bracket members secured respectively to the cap 13 of panel 10 and edge rail 16 of panel 10A, the panel 10A is then moved so as to be positioned perpendicularly adjacent the side of the panel 10, whereupon the main plate 56 of the bracket member 54 is positioned directly over the horizontal plate 63 of the bracket member 55. The screws 62 are then inserted through the aligned openings 61 and 64 so that the horizontal plates 56 and 63 are fixedly drawn snugly together to create a strong and rigid connection between the structural top cap 13 of primary panel 10, and the adjacent upright edge rail 16 of the secondary panel 10A. It should be noted that the securing screws 62 are positioned so that the heads thereof protrude upwardly into the mouth or slot 37 associated with the channel 34 so as to not only be hidden by the top cap 13 associated with the panel 10A, but also not interfere with mounting of the top cap. This bracket arrangement hence enables the top caps 13 and 13A of the connected panels to be maintained in a flush or level relationship, while at the same time maintaining the end of the top cap 13A closely adjacent the side edge of the top cap 13, all as illustrated by FIG. 14, so as to provide highly desirable aesthetics.

Figure 9:
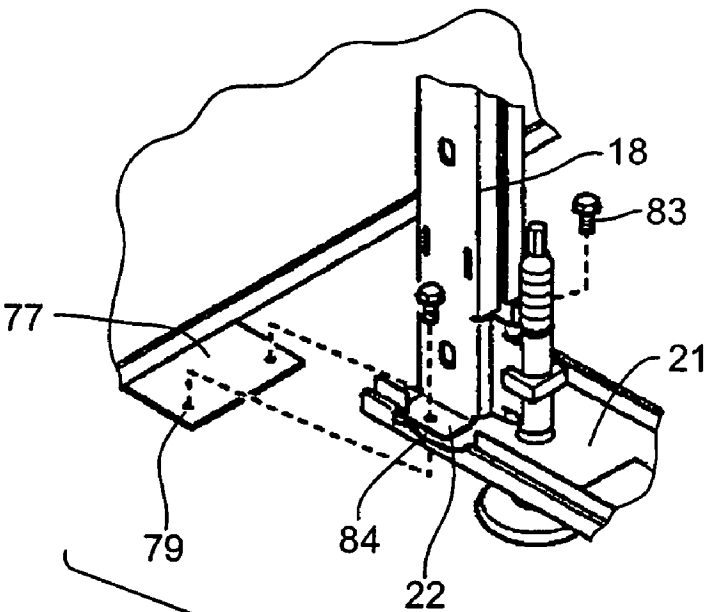
FIG. 9 is an exploded perspective view illustrating the lower bracket structure in a separated condition, for joining lower edges of the first and second panels in transverse relationship.
Figure 11:
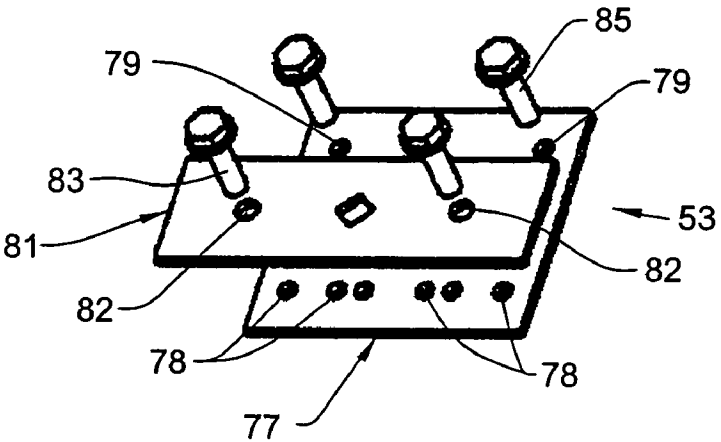
FIG. 11 is an enlarged, exploded perspective view of the lower bracket structure used for transversely connecting first and second panels.

Considering now the lower connecting bracket arrangement 53, and referring specifically to FIGS. 9 and 11, this lower bracket arrangement is defined principally by a main bracket member 77 which is formed generally by a flat metal plate, and which is adapted to be initially fixedly attached to the lower horizontal element of the frame associated with the primary panel 10, and thereafter attached to the lower frame element associated with the secondary panel 10A.

The lower main bracket member 77 has pairs of sidewardly-spaced openings 78 formed therethrough adjacent one edge thereof, and has a further pair of sidewardly spaced openings 79 formed therethrough adjacent the opposite edge thereof. These openings 78 and 79 are provided for permitting rigid securement of the bracket member 77 to the bottom pan 21 of the panel 10, and to the bottom pan 21 of the panel 10A, respectively.

Figure 15:
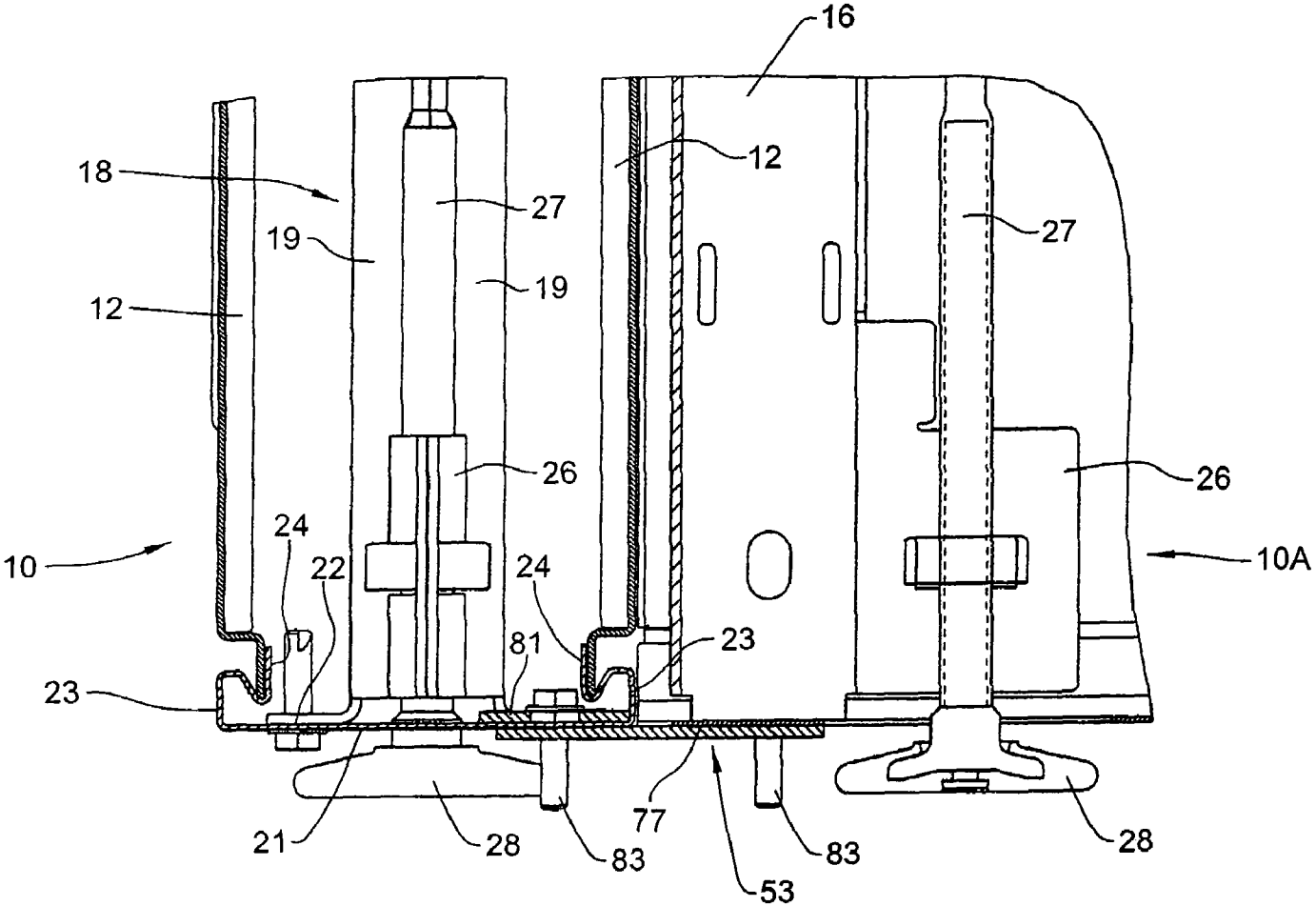
FIG. 15 is an enlarged, fragmentary perspective view which illustrates the lower bracket structure and its manner of joining lower edges of first and second panels in transverse relationship to one another.
Figure 16:
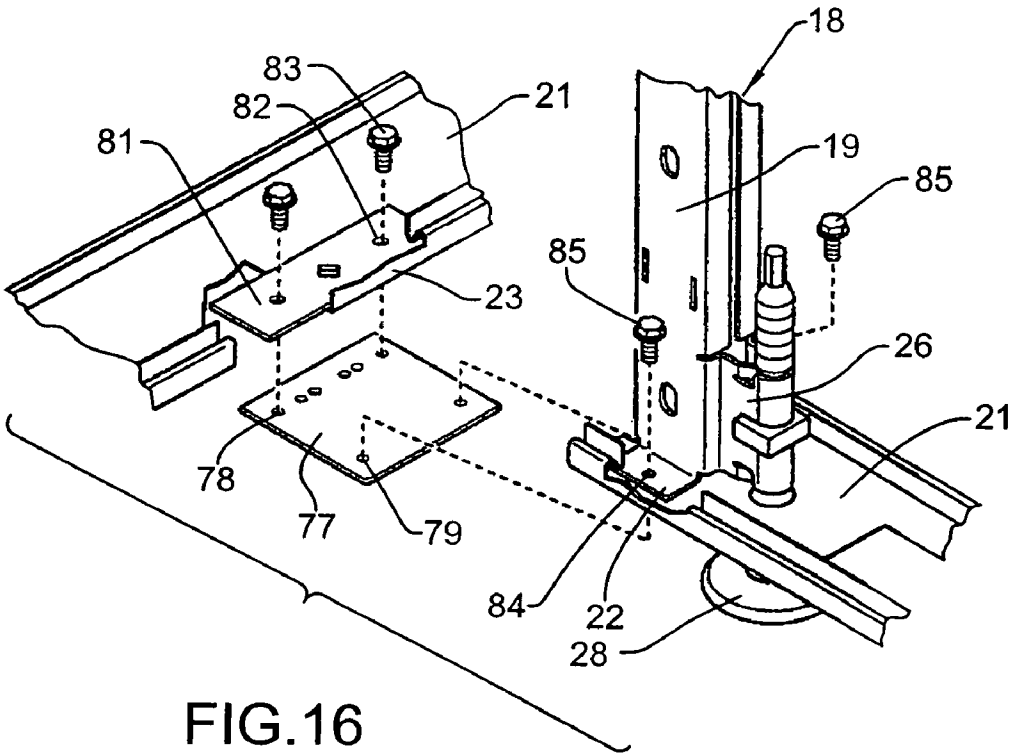
FIG. 16 is a fragmentary, exploded, perspective view which illustrates the manner in which the lower bracket structure cooperates between transversely-oriented first and second panels when the joinder is of the off-module type, that is, at a location spaced between the upright edges of the wall panel, such as illustrated by FIG. 7.

When the panel 10A is being connected to the panel 10 in an off-module relationship substantially as illustrated by FIG. 7, then the bottom connecting bracket assembly 53 also requires use of a secondary bracket member 81 which is also formed as a flat plate and has a pair of openings 82 extending therethrough. The openings 82 are positioned so as to align with the openings 78 formed in the main bracket member 77, and threaded screws or fasteners 83 are adapted for extension through the aligned openings 78 and 82 for securing the plates 77 and 81 on opposite sides of the bottom pan 21 as illustrated by FIGS. 15-16. To effect this assembly, the secondary bracket plate 81 is positioned within the pan 21 and slidably moved sidewardly so as to abut the side edge 23, with the secondary plate 81 being disposed at a desired location lengthwise along the pan 21. Using the holes 82 in plate 81 as templates, a pair of holes are drilled through the horizontal bottom wall of the pan 21, and thereafter the main bracket plate 77 is positioned under the horizontal bottom wall of the pan 21 so that the openings 78 in plate 77 align with the drilled holes in the pan and with the holes 82 in the secondary plate 81. The screws 83, which are preferably self-tapping, are then threaded downwardly through the holes 82 in the plate 81, through the formed holes in the bottom pan 21, and through the holes 78 in the main bracket plate 77. The tightening of these screws 83 effectively fixedly sandwiches the bottom pan 21 between the main bracket plate 77 and the secondary bracket plate 81 substantially as illustrated in FIG. 15. The main bracket plate 77 is hence fixed to the pan but, due to its size, is horizontally cantilevered outwardly beyond the side of the pan substantially as illustrated in FIG. 9.

After the lower bracket arrangement 53 has been fixed to the bottom pan of the main panel 10 and cantilevered sidewardly therefrom as illustrated in FIG. 9, the frame of the secondary panel 10A is then moved into position so that the bottom pan 21 of the panel 10A, in the vicinity of the upright 16, is positioned on top of the protruding bracket plate 77 so that the openings 79 in the bracket plate 77 vertically align with holes or openings 84 (FIG. 9) which extend downwardly through the flanges 22 and pan 21. These holes 84 initially have fastening screws therein, which screws are temporarily removed prior to positioning on the protruding support plate 77. When all of the holes are properly aligned, then appropriate self-tapping screws 83 are again inserted downwardly through the holes 84 and threaded into engagement with the holes 79 of the bracket plate 77 to hence fixedly and rigidly join the lower corner of the frame 11A of the secondary panel 10A to the lower bracket plate 77, which latter plate is fixedly secured to the frame of the primary panel 10. This bracket plate 77 hence provides a rigid connection which also provides desired positional relationship of the panels with respect to one another.

It will be appreciated that the upper and lower brackets will be vertically aligned directly one above the other, and that the lower connecting bracket structure will be fixedly joined between the adjacent panels 10 and 10A first, with the upper bracket structure being fixedly joined thereafter. Due to the fixation of the upper bracket member 56 to the top cap 13 of primary panel 10 by means of set screws, it will be appreciated that these set screws can initially remain loose so as to permit slidable adjustment of the upper bracket member 56 during the assembly process, with these set screws being tightened at the end of the assembly operation so as to permit any small or fine sideward slidable adjustment of the upper bracket so as to ensure proper vertical alignment thereof with the lower bracket.

Figure 17:
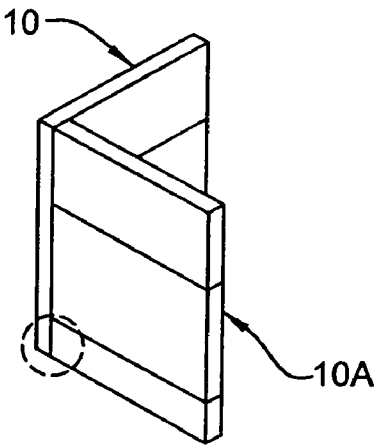
FIG. 17 is a perspective view which illustrates first and second wall panels joined in transverse relation, with the joinder of the second panel to the first panel occurring at the end of the first panel.
Figure 19:
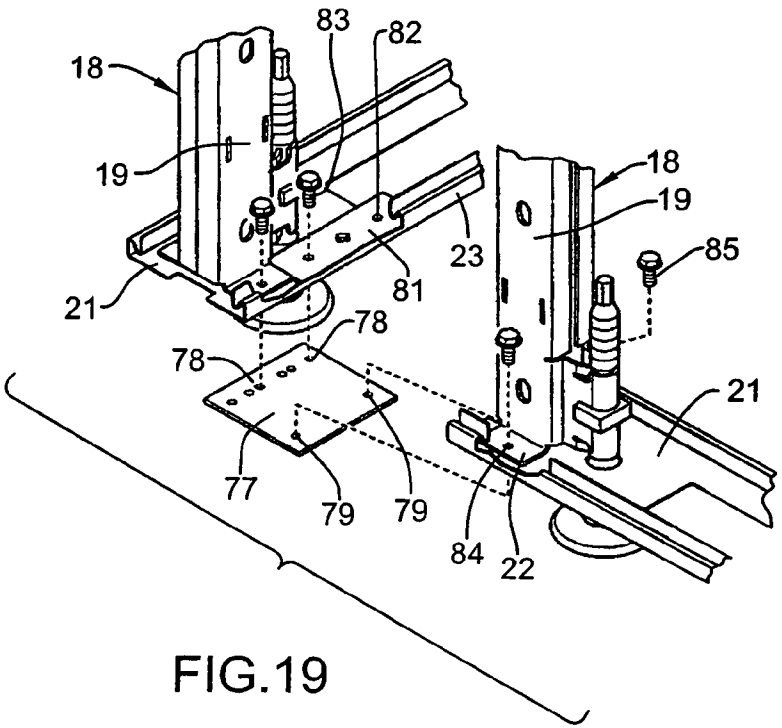
FIG. 19 is a fragmentary, exploded perspective view which illustrates the manner in which the lower bracket structure cooperates between the two panels when the joinder occurs at the edge as illustrated in FIGS. 17-18.
Figure 18:
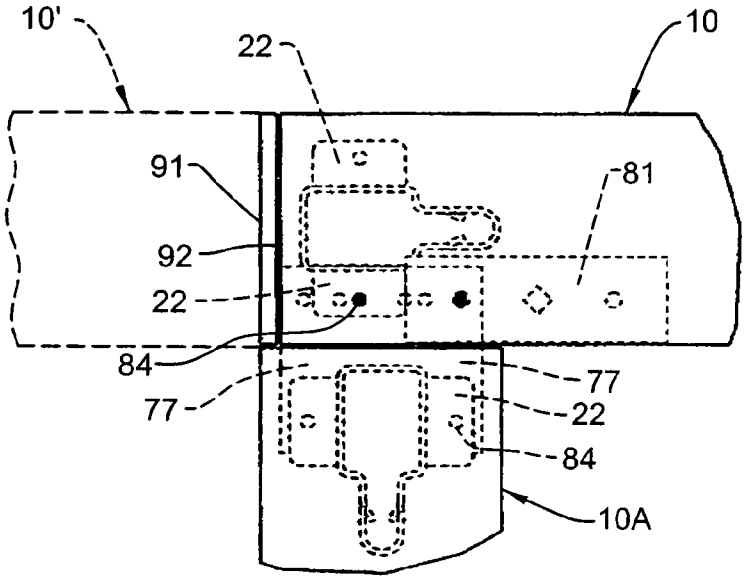
FIG. 18 is an enlarged, fragmentary top view which corresponds to FIG. 17 and which diagrammatically illustrates the panels at the joined ends thereof, and illustrates the general cooperation of the lower bracket structure.
Figure 21:
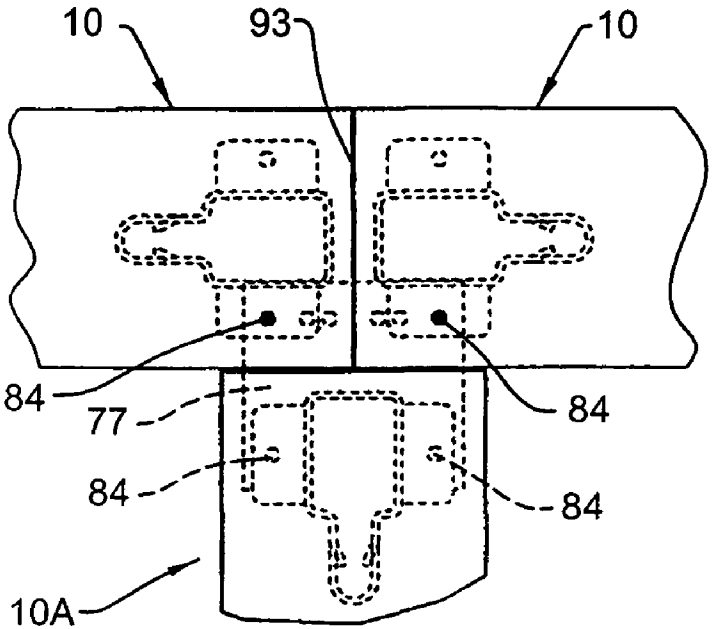
FIG. 21 is a fragmentary enlarged top view of the three joined panels illustrated in FIG. 20, and diagrammatically illustrates the manner in which the bottom bracket structure cooperates therebetween.
Figure 20:
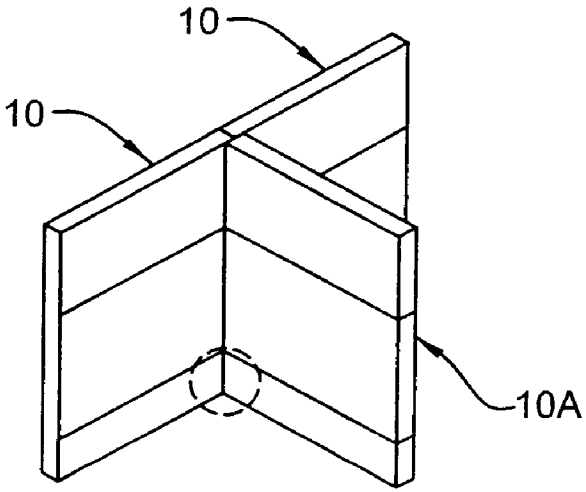
FIG. 20 is a perspective view similar to FIG. 17 but illustrates a wall arrangement wherein a pair of aligned upright panels are joined serially together, and a third panel is joined transversely to the other two panels directly at the upright seam between the first two panels.
Figure 22:
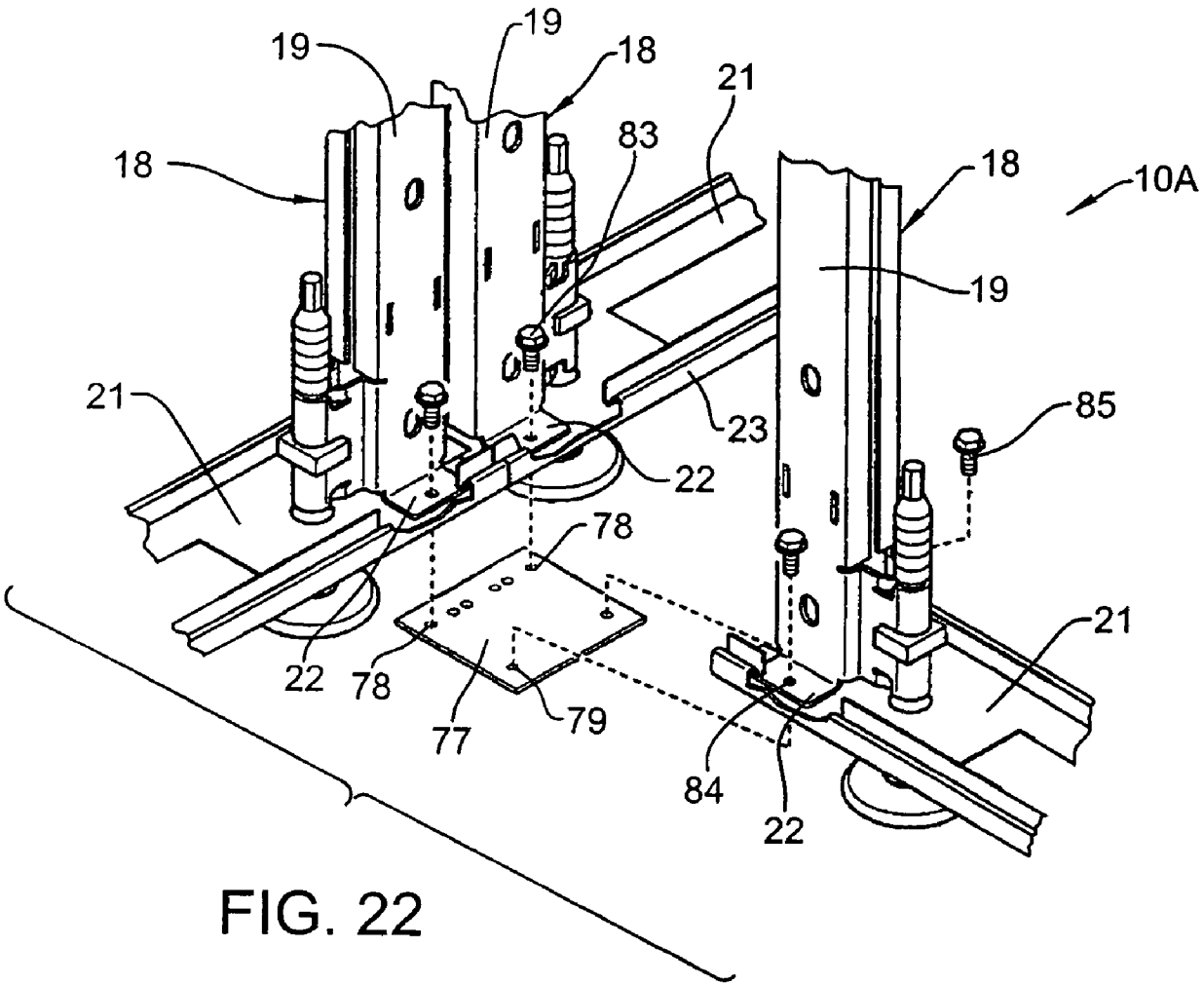
FIG. 22 is an exploded perspective view which illustrates the cooperation of the bottom bracket structure between the three panels when positioned in accordance with FIGS. 20-21.

In addition to permitting perpendicular connection between primary and secondary panels in an off-module manner as described above, the top and bottom bracket assemblies and their cooperation between the primary and secondary panels also permits the secondary panel to be mounted in perpendicular relationship when the secondary panel is aligned generally with one vertical edge of the primary panel as illustrated by FIGS. 17-19, and when the secondary panel is centered on the seam or abutting end edges between serially joined aligned primary panels as illustrated by FIGS. 20-22, as described hereinafter.

As specifically illustrated by FIGS. 17 and 18, it is frequently desirable to perpendicularly join the secondary panel 10A to the primary panel 10 directly adjacent one end edge 92 of the primary panel. When this end edge is exposed, it is typically covered by a thin edge trim 92 which extends vertically therealong, and the secondary panel 10A is positioned so that the one side surface thereof is substantially co-planar with the exterior surface of the edge trim 92 as illustrated by FIG. 18. To create the structural connection between the panels 10 and 10A when in an edge aligned relationship as illustrated by FIGS. 17-18, the top bracket arrangement 52 connects between the panels in the same manner as described above with respect to FIGS. 7-14. The bottom bracket arrangement 53 also connects between the bottom pans of the two panels in a similar manner, although the positioning of the secondary bracket plate 81 is slightly different, as diagrammatically illustrated in FIGS. 18 and 19. In this edge aligned positional relationship, the secondary bracket plate 81 is again positioned on top of the pan 21 and is positioned so as to abut the outer edge 23. In this situation, however, the secondary bracket plate 81 is displaced sidewardly so that it is positioned adjacent and substantially abuts an edge of the adjacent side flange 22 associated with the leg part 18, which side flange 22 and secondary bracket plate 81 have generally the same thickness. The screw which normally extends through the side flange 22 and secures to the pan 21 is removed to expose the hole 84, and the secondary plate member 81 is positioned so that the hole 84 and the adjacent hole 82 in the plate 81 align with a pair of openings 78 formed in the main bracket plate 77 when the latter is positioned in engagement with the undersurface of the pan 21. Self-tapping screws 85 are inserted through the aligned openings to fixedly secure the lower bracket 53 to the pan 21 of the main panel 10. The pan 21 of the secondary panel 10A is thereafter fixed to the protruding bracket plate 77 in the same manner as described above relative to FIG. 15.

While the connection arrangement of FIGS. 17-19 illustrates the primary panel 10 terminating at the connection to the secondary panel 10A so as to define a right-angle corner, it will be appreciated that this same connection can be utilized in a situation where a further panel 10' is serially joined to the primary panel 10, which additional panel 10' is indicated solely diagrammatically by means of dotted lines in FIG. 18. Of course, the trim piece 91 would not be utilized in this latter arrangement.

Referring now to FIGS. 20-22, there is illustrated a perpendicular T-connection arrangement wherein two primary panels 10 are rigidly joined together in serially aligned relationship, and a secondary panel 10A joins perpendicularly to the primary panels at the joint 93 (commonly referred to as the seam) where the two aligned primary panels 10 are joined. The secondary panel 10A, in this arrangement, is positioned so that it is centered on the seam 93, and hence partially overlaps the sides of both primary panels 10. With this construction, the top bracket arrangement 52 is again utilized in the same manner described above, although in this case the guide rail 57 is slidably engaged within the aligned T-shaped guide channels 38 associated with the two aligned top caps 13 which are respectively secured to the two adjacent panels 10. The bracket member 54 hence spans across the adjacent ends of the top caps. As to the bottom bracket arrangement 53, however, in this arrangement only the primary bracket plate 77 is required, and the secondary bracket plate 81 is not utilized. Due to the aligned and adjacent relationship of the two primary panels 10, the lower leg parts 18 of these two panels are positioned closely adjacent one another, as illustrated in FIG. 22, and the adjacent side flanges 22 and specifically the holes 84 formed therethrough are spaced apart by a distance which corresponds to the spacing between a pair of screw openings 78 formed in the main bottom bracket plate 77. Thus, the normal securing screws are removed from the side flanges 22, the main bracket plate 77 is positioned under the adjacent aligned ends of the bottom pans 21 so that the holes 78 therein align with the holes 84 formed through the flanges 22. Suitable fastening screws, preferably self-tapping screws, are then inserted downwardly through the holes 84 in the flanges 22, and are threadably tapped into and through the holes 78 formed in the lower bracket plate 77 to hence fixedly secure the plate 77 so that it attaches to the undersides of the bottom pans 21 and bridges across the adjacent ends thereof, with the plate 77 again being cantilevered sidewardly so as to permit it to be subsequently fixedly joined to the adjacent end of the pan 21 associated with the perpendicular oriented secondary panel 10A.

The improved structural top cap 13 of the present invention is advantageous with respect to its ability to be formed of a length which is sufficient to span and be fixedly secured to the upper edges of two or more aligned panels. In this respect, reference is made to FIG. 23 which diagrammatically illustrates an elongate top cap 113 defined by a one-piece monolithic structure which is formed and has a cross-section identical to the top cap 13 described above, and differs therefrom solely in that its extended length allows it to extend fully across the upper edge of at least two serially and horizontally aligned panels 10-1 and 10-2 as diagrammatically depicted in FIG. 23. With this situation, the extra long top cap 113 is preferably provided with a plurality of carriage bolts 45 slidably supported within the T-shaped channel which extends along the underside thereof, with at least two carriage bolts being provided for association with each panel 10-1 and 10-2, whereupon the carriage bolts 45 are inserted downwardly through openings associated with the top frame rails 14 of the respective panels as the top cap is seated on the adjacent panels, with the elongate top cap then being tightened so as to securely and rigidly seat on the upper edge frame rails 14 associated with the two aligned panels. The continuity achieved by the elongate top cap 113, and its rigid securement to the two adjacent interconnected and aligned panels 10-1 and 10-2, provides the overall upright wall structure defined by the two joined panels with significantly increased stiffness and rigidity, and additionally provides highly improved aesthetics by eliminating the joint or seam which would otherwise exist at the joinder between the two panels. In addition, this multi-panel length top cap 113 is particularly desirable for use in a wall panel arrangement similar to that illustrated by FIGS. 20-22 such that the guide rail associated with the top bracket plate 56 is hence supported within the integrated structure of a single top cap, rather than having to span between the adjacent ends of two separate top caps.

It will be appreciated that the multi-panel length top cap 113 can extend across more than two panels, with the length of the top cap and its cooperation with a number of panels being determined principally by the practicality of being able to manufacture and transport the long top cap, such as by gaining access to a desired work site, and is also controlled by the size (i.e. width) of the individual panels which are serially joined in aligned relationship. Also, corner blocks may be inserted between the frames 10-1 and 10-2 with a third or fourth frame attached to the open faces of the corner blocks to define 3-way and 4-way corner configurations.

Preferably, it is also desirable to provide appropriate space-compensating members beneath the multi-panel length top cap 113 or the shorter top cap 13. More particularly, during the assembly process of the panel frame 11, the vertical frame rails 16 ensure that the elevational height of the ends of the top frame rail 14 is at a consistent and fixed vertical elevation. However, during the extrusion process of the frame rails 14, or during the assembly process thereof, it is possible that undesirable distortion of the linearity of the top frame rail 14 may occur and most typically, it may be found in the frame 11 that the top frame rail 14 may have a slight bow downwardly. As to the top caps 13 or 113, however, it is highly desirable to maintain a constant linear shape of the top cap 13 or 113 since any bowing or waviness of such top cap could prove to be readily noticeable. Hence, the top cap arrangement of the invention also accommodates and eliminates the possibility of such undesirable distortion or waviness along the top cap.

Figure 23:
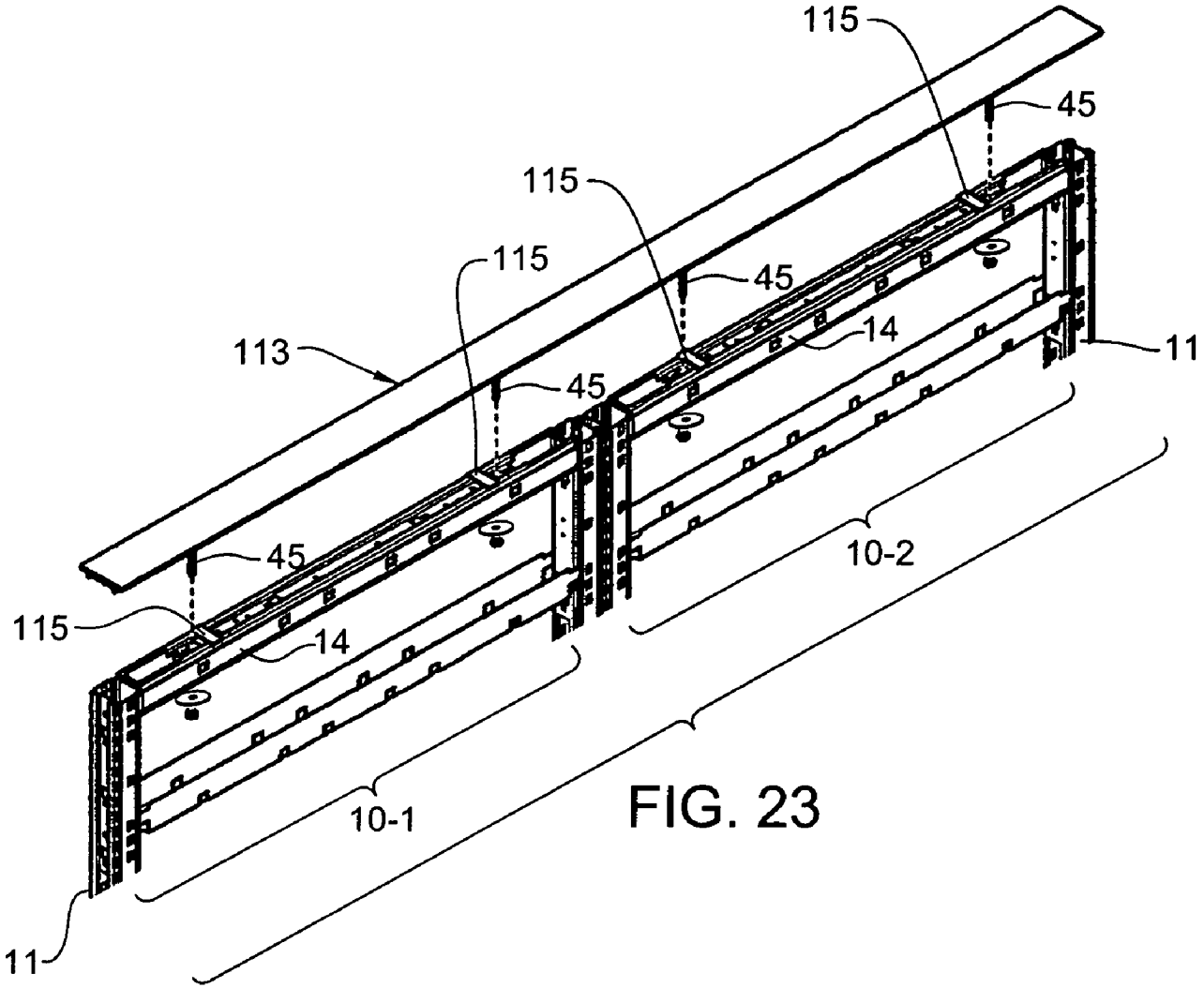
FIG. 23 is a fragmentary perspective view which illustrates a pair of panel frames rigidly joined in aligned relationship, and their cooperation with a single one-piece elongate structural top cap which rigidly joins to and extends along the upper edges of both panels.
Figure 24:
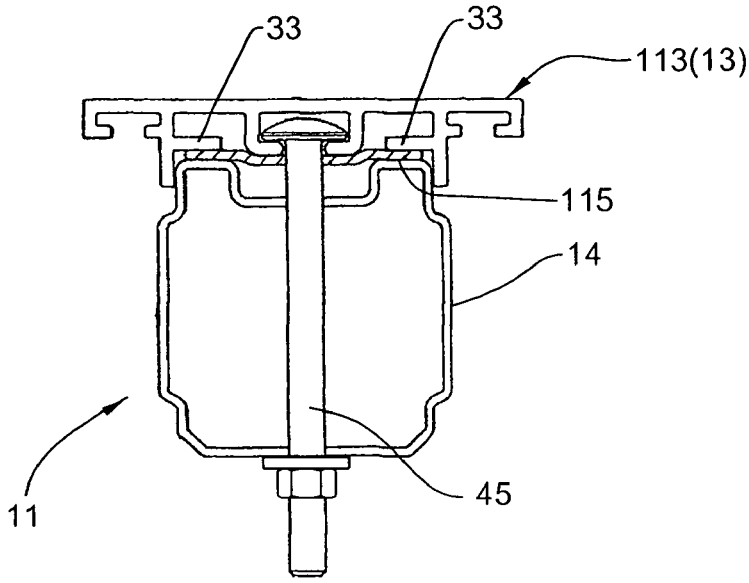
FIG. 24 is an enlarged fragmentary cross-sectional view through the top frame rail and the attached structural top cap of the panel frames of FIG. 23.

More particularly as illustrated in FIG. 23, the panel frames 11 preferably include spacer blocks 115 which are provided at least in pairs at spaced positions along the length of the respective top frame rail 14. Preferably, these spacer blocks 115 are provided closely adjacent to a respective carriage bolt 45. The spacer blocks 115 preferably are formed of a compressible, foam material and have a generally rectangular shape and are thin in the vertical dimension. As seen in FIG. 24, the spacer 115 is positioned on the top surface of the top frame rail 14 and thereby is sandwiched between the frame rail 14 and the stop flanges 33 of the top cap 113 (13). The spacers 115 preferably are resiliently compressible so as to be clamped between these stop flanges 33 of the top cap 113 (13) and have a variable thickness depending upon variations in the overall linearity of the frame rail 14. This provides an improved arrangement for maintaining the linearity and aesthetic appearance of the top cap 113 (13).

Figure 4:
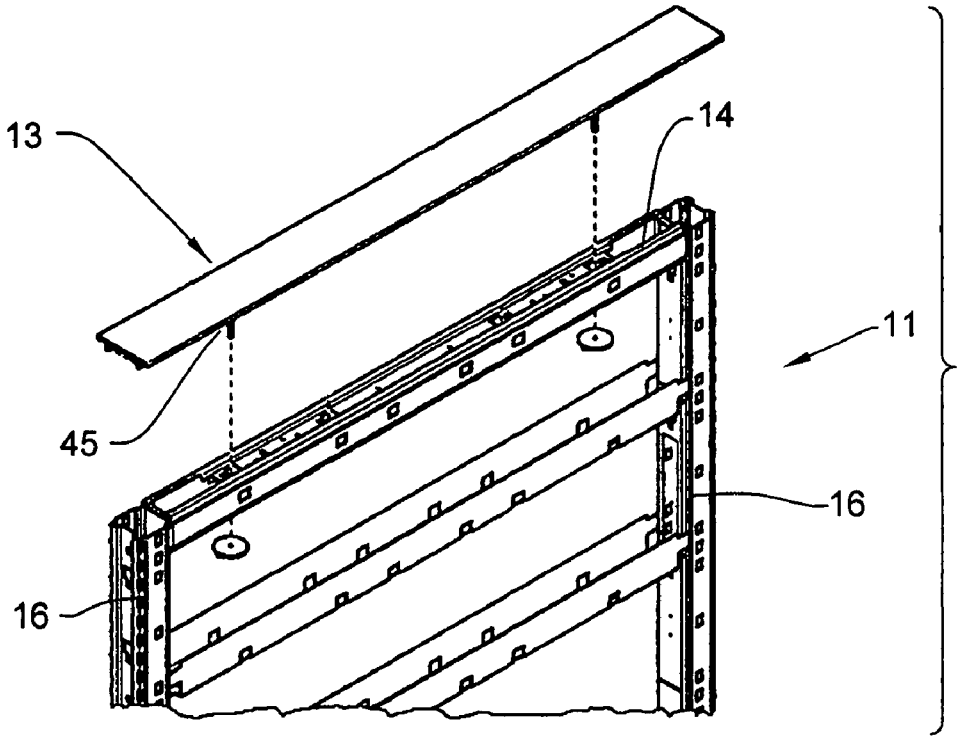
FIG. 4 is a fragmentary perspective view which illustrates the top cap in a separated condition relative to the interior panel frame.

It will be understood that while FIG. 23 illustrates these spacers 115, such spacers 115 are readily positionable on the various panel frames including the panel frame 11 as illustrated in FIG. 4 and the frame of the wall panel 10A as illustrated in FIG. 7.

With the improved structural top cap 13 or 113, and specifically its structural cooperation with the top and bottom bracket arrangements 52 and 53 including specifically the direct structural connection between the top cap and the upper bracket assembly 52, a highly improved structural arrangement having improved strength and rigidity, and hence dimensional control, is achieved while at the same time providing improved access and connectability with respect to joinder of a secondary panel in perpendicular relationship to a primary panel, particularly in an off-module relationship.

Figure 25:
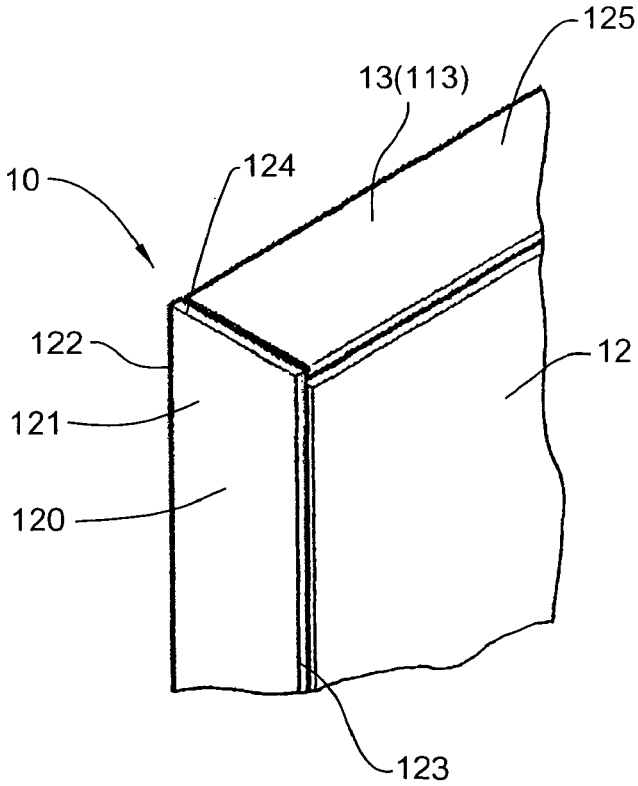
FIG. 25 is an enlarged fragmentary perspective view showing an upper corner of a wall panel with the top cap and end of run trim cover disposed in aligned relation.
Figure 26:
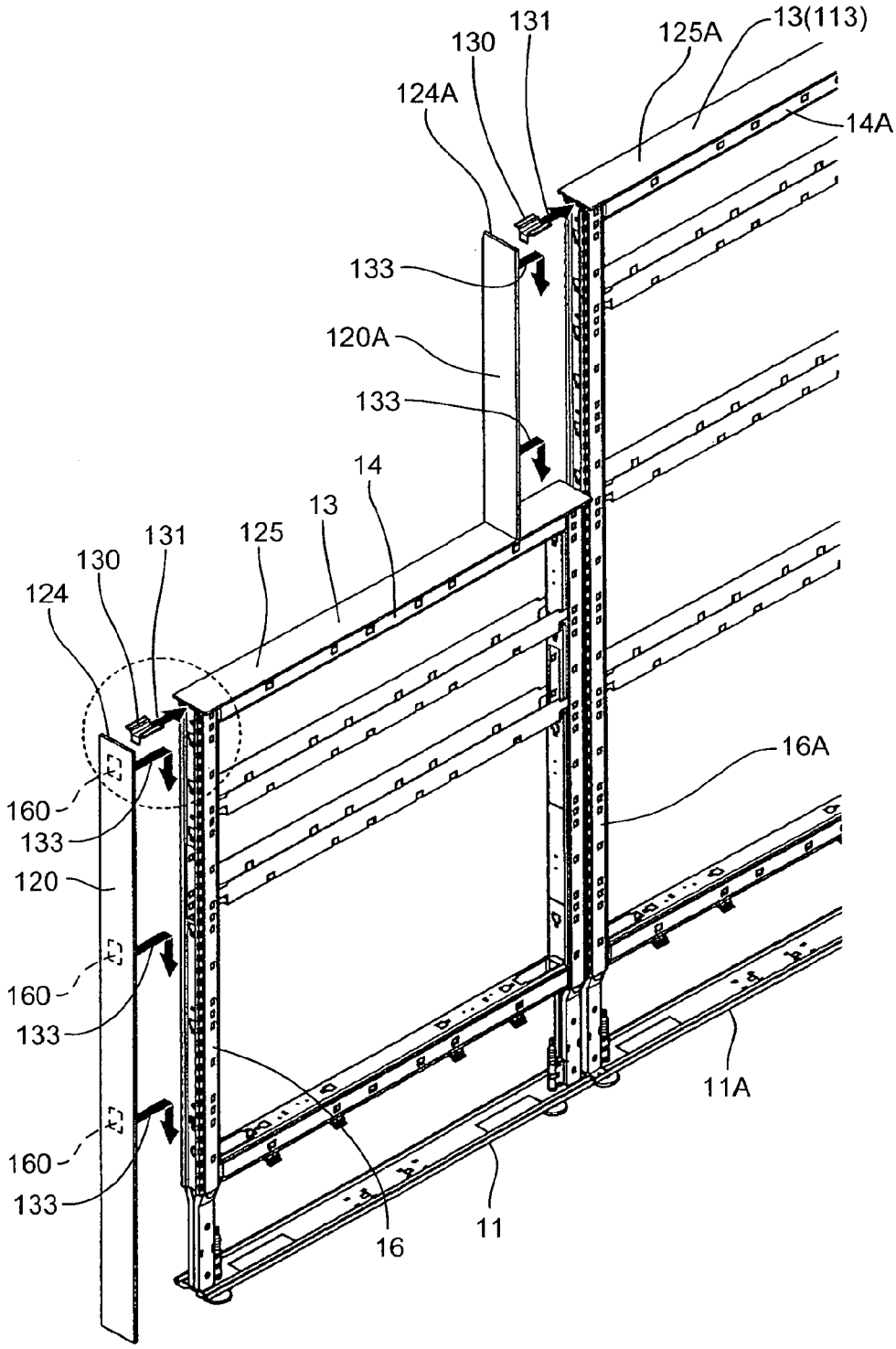
FIG. 26 is a perspective view of serially-connected wall panels illustrating end of run trim covers being attached thereto.

In addition to the improved features of the wall panels 10 as described above, each wall panel 10 also preferably is included with an end trim cover 120 as seen in FIGS. 25-26 which is removably mounted to the wall panel frame, as described below, so as to aesthetically finish the end of the panel frame 11 while at the same time being in precise alignment with the top cap 13 or the alternative top cap 113.

More particularly as seen in FIG. 25, the trim cover 120 is defined by an exterior face 121, longitudinally parallel side faces 122 and an upper end face 124. With the alignment arrangement of the invention as further described hereinafter, the alignment arrangement ensures that the upper end face 124 is horizontally aligned and coplanar with the upper face 125 of the top cap 13. This alignability of the upper end face 124 and top cap face 125 is accomplished through the direct interconnection of the trim cover 120 and top cap 13 and is not dictated by the interconnection of the trim cover 120 with the panel frame 11.

Referring to FIG. 26, two different height panel frames are illustrated, namely frame 11 and vertically-enlarged frame 11A which are joined serially together in end-to-end relation by appropriate carriage bolts. Due to the different frame elevations, the top frame rail 14 of the frame 11 and the top frame rail 14A of the frame 11A are at different vertical elevations, one with respect to the other. For the frame 11, a single-length top cap 13 is provided and is mounted thereto in accord with the above description. For the frame 11A, this frame 11A may be provided as a single unit or provided serially adjacent to another frame 11A such that the top cap may be a single-length top cap 13 or a multi-panel length top cap 113. In either case, the trim cover 120 or the shorter-length trim cover 120A is mounted to its respective top cap 13 (113) through an identical mounting arrangement which ensures alignment of the trim end face 124 or 124A with the adjacent top cap face 125 or 125A. The following discussion relates primarily to the trim cover but is equally applicable to trim cover 120A.

Figure 28:
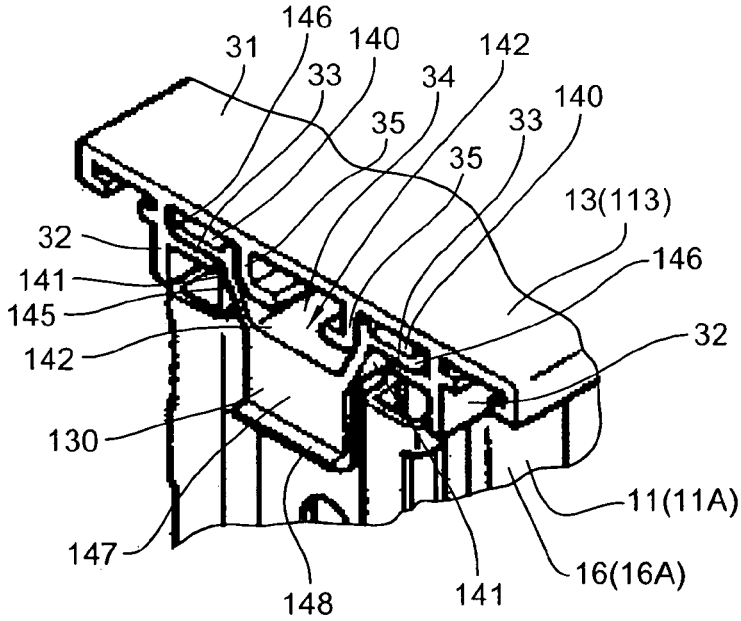
FIG. 28 is an enlarged fragmentary perspective view illustrating the locator clip fully inserted in position within the top cap.

Generally, the interconnection of the trim covers 120 or 120A with its associated top cap 13 or 113 is accomplished through an identical locator clip 130 which is insertable horizontally sidewardly into engagement with the open end of the top cap 13 or 113 as indicated by reference arrows 131. Once the locator clip 130 is fitted into position in the associated top cap 13 (113), as seen in FIG. 28, the associated trim cover 120 (120A) is shifted horizontally sidewardly into engagement with the locator clip 130 and then shifted downwardly to secure the trim cover 120 to the associated vertical frame rail 16 (16A). This sideward and downward shifting of the trim covers is indicated generally by reference arrows 133 in FIG. 26.

Figure 27:
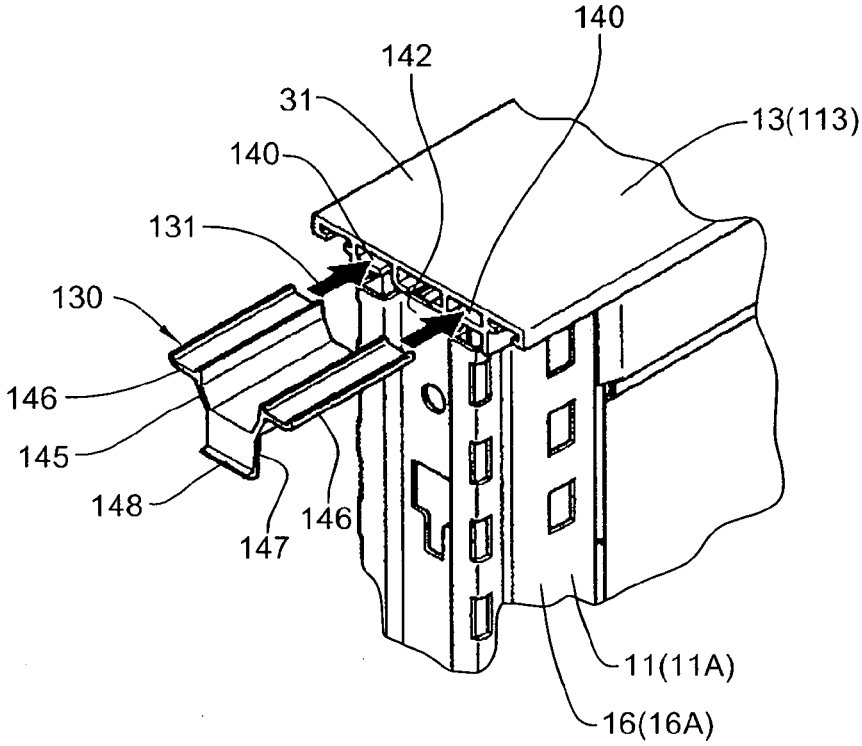
FIG. 27 is an enlarged fragmentary perspective view showing a locator clip being inserted into the open end of the top cap.

More particularly as to FIGS. 27 and 28, the locator clip 130 is illustrated as being inserted into and fixed in position within the open end of the top cap 13. As described above, such as with respect to FIGS. 5 and 6, the cross-sectional profile of the top cap 13 includes the top wall 31, downwardly depending side walls 32, horizontal stop flanges 33 and the spaced side flanges 35 which define the channel 34. As a result, a slot 140 (FIGS. 5, 6, 27 and 28) is defined between each of the stop flanges 33 and the top wall 31 wherein each slot 140 also has an elongate open side 141 defined between the free end of the stop flange 33 and the bottom corner of the channel side flange 35. It is noted that ends of the slots 141 also open horizontally sidewardly from the opposite ends of the top cap 13.

Still further as best illustrated in FIG. 6, the channel side flanges 35 also are spaced vertically upwardly above a lengthwise recess 142 that is formed in the top frame rail 14. Thus, this recess 142 defines an elongate space located below these channel side flanges 35 for receipt of the locator clip 130.

More particularly as to the locator clip 130, this locator clip 130 is preferably formed of a suitably rigid material such as plastic and has a main central body 145 having an upward opening U-shape as seen in FIG. 27. The upper ends of this main clip body 145 have wings 146 which project horizontally sidewardly from the side legs of the main body 145 and are adapted to slide into the open ends of the slots 140 formed in the top cap 13. These wings 146 exit the slots 140 by passing through the open slot sides 141 (FIGS. 5 and 27) and transitioning into the main body 145 wherein the main clip body 145 is slid sidewardly into the frame rail recess 142 as best seen in FIG. 28.

To locate the trim cover 120, the main clip body 145 includes a downwardly depending leg 147 which is located exteriorly of the top cap 13 and terminates at its lower distal end in a locator ledge 148. This locator ledge 148 thereby projects horizontally outwardly from the end face of the vertical frame rail 16 (16A) for engagement with the corresponding trim cover 120 or 120A.

Figure 29:
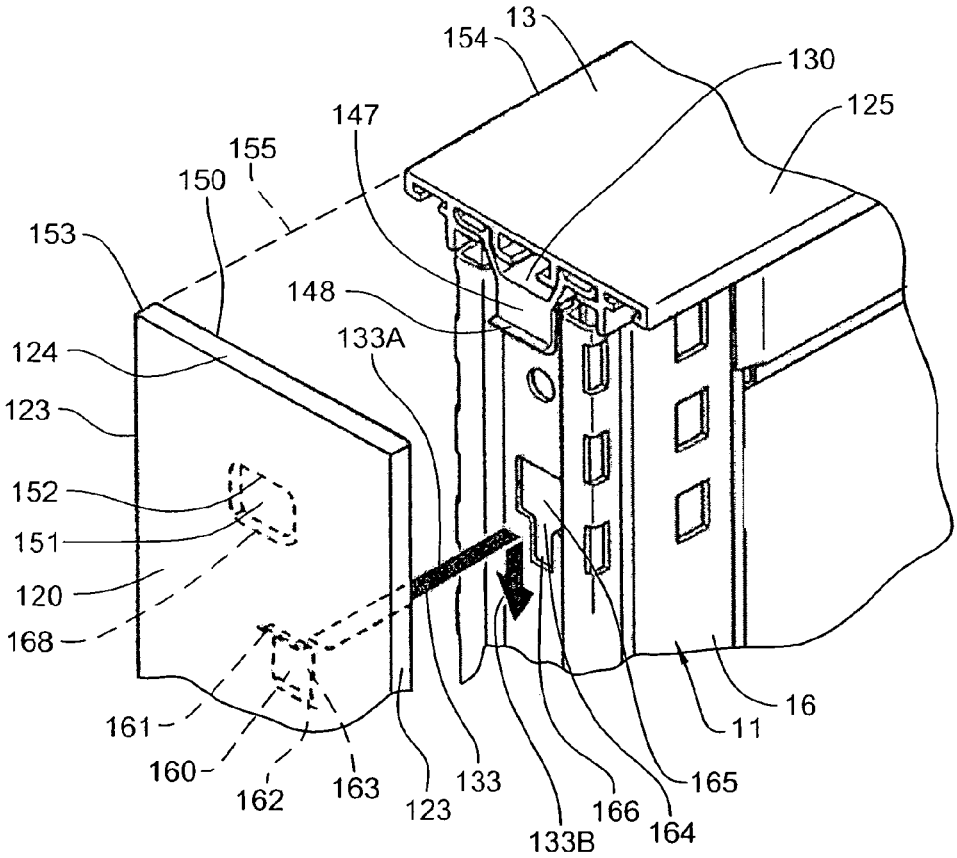
FIG. 29 is an enlarged fragmentary perspective view showing an end of run trim cover being mounted to the locator clip.

Turning next to FIG. 29, the trim cover 13 also is provided with an inside face 150 which is formed with a locator pocket 151 or other formation that preferably has a rectangular shape and opens sidewardly towards the panel frame 11. In particular, the pocket 151 is defined by an upper pocket edge that defines a downward facing flat surface that is adapted to seat onto the clip ledge 148. The overall vertical dimension between this pocket edge 152 and the upper end face 124 of the trim cover 120 is precisely defined so that when the pocket edge 152 is positioned onto the clip ledge 148, the trim cover 120 is thereby suspended on and supported vertically by the locator clip 130 at a consistent vertical position relative to the top cap 13. It is noted that the clip ledge 148 and the top face 125 of the top cap 13 when assembled have a vertical dimension which precisely corresponds to the vertical dimension between the pocket edge 152 and the trim end face 124 such that when the trim cover 120 is suspended from the locator clip 130, the respective corners 153 and 15A of the trim cover 120 and top cap 13 are precisely aligned as diagrammatically illustrated by dashed reference line 155 and further as a result thereof, the trim end face 124 and top cap face 125 are substantially coplanar and aligned substantially flush with each other.

To prevent removal of the trim cover 120 from the associated panel frame 11, the inside face 150 of the trim cover 120 is provided with a cantilevered spring clip 160 proximate the upper end thereof. This spring clip 160 includes a fixed upper end 161 and a distal free end 162 formed at the end of the resiliently cantilevered spring body 163. This free end 162 is spaced inwardly from the trim cover face 150 and is aligned for insertion into a corresponding T-shaped window 164 that is formed in the vertical frame rail 11. This window 164 has a generally rectangular T-shape defined by a wide upper section 165 and a narrow bottom section 166. Normally, this T-shaped window 164 accommodates a carriage bolt which is inserted horizontally therethrough to join two serially-adjacent panel frames 11 together. However, at the end of run position as depicted in FIG. 26, the resilient attachment clip 160 on the trim cover 120 is adapted to be fitted through this window 164 and then secured to the end rail wall of the vertical frame rail 16.

In particular, as depicted in FIG. 29, the spring body 163 is inserted interiorly into the frame rail 16 through the wide window section 165 during the horizontal shifting movement of the trim cover 120 indicated by reference arrow 133 and specifically arrow segment 133A. Once the trim cover 120 is positioned in abutting facing relation with the vertical frame rail 16, the trim cover 120 is then shifted downwardly as indicated by reference arrow 133 and arrow segment 133B thereof, wherein the spring body 163 slides over the frame rail wall adjacent to the thin window section 166 so that the wall thickness of the vertical frame rail 16 is gripped by this spring clip 160.

Preferably, as depicted in FIG. 26, each trim cover 120 is provided with a plurality of such spring clips 160 that are vertically spaced apart and aligned with corresponding T-shaped windows 164. These spring clips 160 thereby fit through the corresponding wide window section 165 and then shift downwardly to grip the frame wall in the region of the narrow window section 166 to thereby horizontally position and retain the trim cover 120 against the opposing rail face. This vertical shifting of the trim cover is permitted by the vertical height of the pocket 151. More particularly, during horizontal positioning of the trim cover 120, the locator clip ledge 148 would be located proximate to the lower pocket edge 168 (FIG. 29) and then the upper pocket edge 152 would be shifted downwardly so as to rest on top of the ledge 148 after the downward vertical shifting of the trim cover 120 indicated by arrow segment 133B. In this manner, the trim cover 120 or trim cover 120A is precisely aligned relative to its associated top cap 13 or 113 to provide an improved aesthetic appearance as defined by the top caps and end trim covers.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An upright space-dividing wall panel, comprising:

an upright inner rigid frame including a pair of upright edge rails disposed in sidewardly spaced relation for defining opposite upright edges of the frame, a top cross rail rigidly joined to and extending generally horizontally between upper ends of said upright edge rails, and a generally horizontally extending bottom member fixed to and extending between lower ends of said edge rails;

at least one side cover attached to and covering each exposed side of said frame for enclosing said frame, said side cover defining an outer cover face which faces outwardly from said frame and an upper cover edge extending along said frame;

a horizontally elongate one-piece structural top cap disposed above and seated on said top rail and extending lengthwise thereof along the full length of said frame;

a plurality of threaded fasteners positioned in predefined mounting locations at spaced lengthwise intervals along said top cap and coupled between said top cap and said top rail for rigidly securing and seating said top cap on said top rail;

said structural top cap having a top wall defining a bottom wall surface and a downwardly opening T-shaped channel extending lengthwise throughout the full length thereof, said T-shaped channel being centered along a lengthwise-extending central vertical plane of said top cap and being accessible solely from the bottom or ends thereof, said T-shaped channel being defined by channel walls projecting downwardly below said bottom wall surface;

said structural top cap further having a downwardly protruding and downwardly opening channel structure which extends lengthwise of the cap and which creates a snug, nested, seated engagement with an upper part of said top frame rail, said channel structure includes a pair of side legs which are cantilevered downwardly from said top wall of said top cap below said bottom wall surface and which extend in parallel relationship lengthwise of said top cap, said side legs being sidewardly spaced apart outwardly of said T-shaped channel to permit the upper part of said top frame rail to nest upwardly therebetween, each said side leg of said channel structure including a stop spaced below said bottom wall surface of said top wall, said stop being disposed above and abutting downwardly against a top surface of said top rail when the latter is upwardly nested between said side legs such that said T-shaped channel is spaced upwardly above said top rail and said top surface of said top rail is spaced from and below said bottom wall surface in non-contacting relation;

each said threaded fastener including an elongate threaded shaft having an enlarged head at an upper end thereof, said head being confined for lengthwise horizontal sliding movement within an enlarged upper channel part of said T-shaped channel, and said shaft protruding downwardly through a lengthwise-extending narrow mouth which upwardly accesses said upper channel part with said shaft protruding downwardly for engagement with said top rail at said predefined mounting location associated therewith to draw said top cap downwardly against said top rail.

2. A wall panel according to claim 1, wherein said structural top cap includes overhanging side parts which extend lengthwise of the top cap and which protrude sidewardly in opposite directions so as to be disposed in overhanging relationship adjacent opposite lengthwise-extending sides of said top rail, each said overhanging side part including a downwardly-opening guide channel extending lengthwise of said top cap in sidewardly spaced but generally parallel relationship to said T-shaped channel, said guide channel opening downwardly and located inwardly of an exterior side face of said top rail and inwardly of said outer cover face wherein said upper cover edge is spaced downwardly below said guide channel to define a horizontal slot vertically between said overhanging side part and said upper cover edge, which said slot provides sideward access to said guide channel from an exterior of said wall panel.

3. A wall panel according to claim 2, including a bracket having an elongate rail part confined in and slidable along said guide channel and said slot, said bracket also having a main bracket plate which is fixed to said rail part and which extends outwardly from said slot and is disposed vertically between said overhanging side part and said upper cover edge and is horizontally cantilevered sidewardly away from said frame for attachment to a second upright panel which protrudes perpendicularly away from a side face of the panel which mounts the bracket thereon.

4. A wall panel according to claim 3, wherein the guide channel has a generally T-shaped cross-section disposed in a normal upright orientation so as to captivate the guide rail of said bracket therebetween except for permitting horizontal sliding of said guide rail in the lengthwise direction of said guide channel along said slot.

5. A wall panel according to claim 1, wherein said structural top cap includes overhanging side parts which extend lengthwise thereof and which protrude sidewardly in opposite directions outwardly beyond said side legs so as to be disposed vertically above said upper cover edge of said side cover in vertically spaced relation, each said overhanging side part including a downwardly-opening guide channel extending lengthwise of the top cap in sidewardly spaced but generally parallel relationship to said T-shaped channel, said guide channel opening downwardly toward said upper cover edge and said T-shaped channel being positioned sidewardly between said side legs and disposed adjacent an upper extremity of the downwardly-opening channel defined therebetween.

6. A wall panel according to claim 1, wherein said structural top cap is a monolithic one-piece metal member having a uniform cross-section throughout substantially the entire length thereof.

7. A wall panel according to claim 1, wherein the enlarged head of said fastener is solely slidably inserted into the enlarged channel part through one end thereof as defined at a free end of the top cap.

8. A wall panel according to claim 7, wherein the fastener comprises an elongate carriage bolt having a non-circular shaft part which joins to the head and which projects downwardly through the mouth of said T-shaped channel to restrain said bolt from rotating.

9. A wall panel according to claim 1, further comprising:

a locator clip having an insert portion which is insertable horizontally into said T-shaped channel of said top cap through said open end thereof to fix the vertical position of said locator clip relative to said top cap, said locator clip having an exterior portion disposed adjacent said upright edge rails on the exterior thereof and having a locator section formed in said exterior portion at a fixed vertical position disposed below said top cap top wall; and an end trim cover which terminates vertically at an upper end face and is vertically elongate to overlie and sidewardly cover a side section of said side cover and enclose said exterior portion of said locator clip to define a finished appearance thereof, said trim cover including a cooperating locator portion which is engagable with said locator section of said locator clip to define the vertical position of said trim cover relative to said top cap independently of said frame, said cooperating locator portion spaced downwardly below said upper end face, wherein said end trim cover overlies and hides said locator section and said cooperating locator portion from view.

10. A wall panel according to claim 9, wherein said locator clip and said trim cover comprise cooperating edges which define said locator portion.

11. A wall panel according to claim 10, wherein said edge on said trim cover is defined by a pocket which opens sidewardly toward said frame.

12. A wall panel according to claim 11, wherein said edge on said locator clip is defined by a ledge projecting sidewardly and supporting said edge of said pocket.

13. A wall panel according to claim 10, wherein said trim cover comprises said upper end face, at least a portion of which lies in the same plane as the top wall of said top cap.

14. A wall panel according to claim 9, wherein said trim cover overlies and encloses said locator section from view such that said upper end face and said upper cap face are substantially flush.

15. A wall panel according to claim 14, wherein said trim cover includes retaining structure which secures said trim cover to said side frame to prevent sideward movement while permitting vertical movement of said trim cover, said locator clip being engaged with said trim cover when secured to said side frame to fix said vertical position of said trim cover.

16. In an upright space-dividing wall panel having a rigid internal frame which includes a horizontally elongate top frame rail, side covers attached to opposite vertical faces of said frame for enclosing said frame, and a horizontally elongate structural top cap mounted above said top frame rail and extending therealong for defining an upper edge of said panel, comprising the improvement wherein:

said top cap comprises a monolithic one-piece elongate member which has a length corresponding at least to the horizontal length which extends along an upper edge of said frame;

said top cap including a top wall which extends throughout the length thereof and which has a width which exceeds the width of said top frame rail so that the top cap has lengthwise-extending side edge parts positioned adjacent opposite side edges thereof, each of said side edge parts being spaced vertically above an upper cover edge of an adjacent one of said side covers to define a sideward-opening slot therebetween, and defining a downwardly-opening support channel opening toward said upper cover edge which said support channel opens downwardly into said slot and is accessible through said slot for accommodating therein a mounting part of an accessory, said top cap also including a channel structure which is fixed to and protrudes downwardly from said top wall along the lengthwise extent thereof, said channel structure having a transverse width which generally corresponds to the width of a top portion of said top frame rail so as to create a seated nesting engagement therewith, said side edge parts being positioned sidewardly outwardly from said channel structure wherein said channel structure is disposed inwardly of said slot, said channel structure including at least two sidewardly projecting stop members spaced below said top wall and abutting a top surface of said top rail when said top rail is in nested engagement with said top cap wherein said top surface of said top rail is spaced below said top wall; and a plurality of fasteners detachably carried on said top cap and protruding downwardly therefrom for creating a fixed engagement with the top frame rail to rigidly seat the top cap to the top frame rail;

said top cap having a downwardly-opening fastener confinement channel extending lengthwise thereof generally along a lengthwise extending centerline of the top cap, said fastener having a head part which is captivated in said fastener confinement channel to prevent vertical separation therebetween and said head part and said fastener confinement channel being spaced vertically above said top rail at a spacing defined by abutment of said stop members with said top surface of said top rail to effect drawing down of the top cap into engagement with the frame top rail.

17. A wall panel according to claim 16, wherein the fastener has an enlarged head which is captivated within said channel, said channel extending throughout the full length of said top cap, and said enlarged head being insertable into said channel solely from an open end of the channel as defined at a free end of the top cap, said fastener having a shaft which protrudes downwardly through a vertical opening arrangement formed in the top cap for accommodating a threaded fastener on a lower end thereof to snugly draw the top cap into fixed seated engagement with the top frame rail.

18. A wall panel according to claim 17, wherein the top cap is of extruded aluminum, and wherein the top cap is free of openings or perforations extending through the top wall thereof.

19. An upright space-dividing wall panel, comprising:

an upright load-bearing rigid frame including a pair of upright edge rails disposed in sidewardly spaced relation for defining opposite upright edges of the frame, a top cross rail rigidly joined to and extending generally horizontally between upper ends of said upright edge rails, and a generally horizontally extending bottom member fixed to and extending between lower ends of said edge rails, said top cross rail having an upward facing top surface;

at least one side cover attached to and covering each exposed side of said frame for enclosing said frame;

a horizontally elongate one-piece structural top cap disposed above and seated on said top rail and extending lengthwise thereof along a length of said frame;

a plurality of threaded fasteners positioned at spaced lengthwise intervals along said top cap and coupled between said top cap and said top rail for rigidly securing and seating said top cap on said top rail;

said structural top cap having a top wall and channel walls projecting downwardly from a bottom wall surface of said top wall and thereby defining a downwardly opening T-shaped channel extending lengthwise throughout the full length thereof, said channel being centered along a lengthwise-extending central vertical plane of said top cap and being accessible solely from the bottom or ends thereof;

said structural top cap further having a downwardly protruding and downwardly opening channel structure which extends lengthwise of the cap and which creates a snug, nested, seated engagement with an upper part of said top frame rail, said channel structure includes a pair of side legs which are cantilevered downwardly from said bottom wall surface of said top wall of said top cap and which extend in parallel relationship lengthwise of said top cap, said side legs being spaced outwardly of said channel walls and being sidewardly spaced apart to permit the upper part of said top frame rail to nest upwardly between said side legs, said channel structure also including a stop spaced below said bottom wall surface of said top wall, said stop engagable with said top surface of said top rail when the latter is upwardly nested between said side legs wherein a clearance space is defined between said top frame rail and said top surface thereof and the entirety of said channel walls when said stop engages against said top surface;

each said threaded fastener including an elongate threaded shaft having an enlarged head at an upper end thereof, said head being confined for lengthwise horizontal sliding movement within an enlarged upper channel part of said T-shaped channel defined by said channel walls, and said shaft protruding downwardly through a lengthwise-extending narrow mouth defined by said channel walls which upwardly accesses said upper channel part with said shaft protruding downwardly for engagement with said top rail wherein said clearance space allows said threaded fastener to draw said stop downwardly into direct contact with said top surface while avoiding contact between said channel walls and said top cross rail.

20. A wall panel according to claim 19, wherein said structural top cap includes structurally rigid side parts which extend lengthwise of the top cap and which protrude sidewardly in opposite directions so as to be disposed adjacent opposite lengthwise-extending sides of said top rail, each said structurally rigid side part including a downwardly-opening guide channel extending lengthwise of said top cap in sidewardly spaced but generally parallel relationship to said T-shaped channel, said guide channel opening downwardly adjacent an exterior side face of said top rail, said wall panel including a bracket having an elongate rail part confined in and slidable along said guide channel, said bracket also having a main bracket plate which is fixed to said rail part and which is horizontally cantilevered sidewardly away from said frame for rigid attachment to a second upright panel which protrudes perpendicularly away from a side face of the panel which mounts the bracket thereon, wherein said bracket and said top cap transmit structured loads between a wall panel and said second upright panel attached thereto.

21. A wall panel according to claim 20, wherein said structural top cap is a monolithic one-piece metal member having a uniform cross-section throughout substantially the entire length thereof.

22. A wall panel according to claim 21, wherein the enlarged head of said fastener is solely slidably inserted into the enlarged channel part through one end thereof as defined at a free end of the top cap, and wherein the fastener comprises an elongate carriage bolt having a non-circular shaft part which joins to the head and which projects downwardly through the mouth of said T-shaped channel to restrain said bolt from rotating.

23. A wall panel according to claim 19, further comprising at least one spacer insertable between said top cross rail and said stop of said top cap to vary a distance between said stop and said top surface with said spacer disposed in compression therebetween.

24. A wall panel according to claim 23, wherein said spacer is deformable under compression by drawing said stop toward said top surface by a proximate one of said fasteners to vary a contour of a top surface of said top cap relative to a horizontal plane.

* * * * *